United States Patent [19]

Apps et al.

[11] Patent Number: 4,972,696

[45] Date of Patent: Nov. 27, 1990

[54] FORMING ELONGATE STRUCTURAL COMPONENTS

[75] Inventors: Howard R. Apps; Adrian D. Lucas, both of Woodford; Philip C. Fairhall, North Cheam, all of United Kingdom

[73] Assignee: British Aerospace Public Limited Company, London, England

[21] Appl. No.: 317,985

[22] Filed: Mar. 2, 1989

Related U.S. Application Data

[62] Division of Ser. No. 94,749, Sep. 9, 1987, Pat. No. 4,878,369.

[30] Foreign Application Priority Data

Sep. 9, 1986 [GB] United Kingdom ..... 8621725

[51] Int. Cl.[5] ..... B21D 11/14

[52] U.S. Cl. ..... 72/9; 72/12; 72/299; 72/307; 72/371

[58] Field of Search ..... 72/371, 306, 299, 64, 72/65, 307, 7, 9, 12, 34

[56] References Cited

U.S. PATENT DOCUMENTS

| | | | |
|---|---|---|---|
| 3,280,607 | 10/1966 | Esken et al. . | |
| 3,906,765 | 9/1975 | Foster | 72/9 |
| 3,955,389 | 5/1976 | Foster | 72/9 |
| 4,080,815 | 3/1978 | Foster | 72/65 |
| 4,367,641 | 1/1983 | Mizutani | 72/65 |

FOREIGN PATENT DOCUMENTS

| | | | |
|---|---|---|---|
| 127935 | 12/1984 | European Pat. Off. . | |
| 41025 | 4/1981 | Japan | 72/371 |
| 821681 | 9/1954 | United Kingdom . | |
| 1050420 | 12/1964 | United Kingdom . | |
| 1482271 | 7/1973 | United Kingdom . | |
| 2021455 | 12/1979 | United Kingdom . | |

*Primary Examiner*—Daniel C. Crane

*Attorney, Agent, or Firm*—Nixon & Vanderhye

[57] ABSTRACT

A system for forming components to have a predetermined contour includes a manipulator having four manipulating heads 44, 52, 56, 58 which engage longitudinally spaced portions of the component. The system uses the manipulator to determine the initial contour of an increment of the length of the component, compares the measured contour with the required contour to determine the contour or shape error and then controls the manipulator to apply one or more permanent set deflections in accordance with the required contour. The manipulator is then advanced relative to the component and further measuring and deflections steps are performed until the component has the required contour.

8 Claims, 34 Drawing Sheets

PLASTIC DEFN. = DEFLECTION INCREMENT-ELASTIC DEFN.
= DEFLECTION INCREMENT-(LOAD INCREMENT/e)

28
34
42
46
62
52
30
18
20
26
40
40
29
7
7
32
36
34
46
48
60
50
22
20
24

FORMING ELONGATE STRUCTURAL COMPONENTS

This application is a division of U.S. Pat. application Ser. No. 94,749, filed Sept. 9, 1987, now U.S. Pat. No. 4,878,369, issued Nov. 7, 1989.

This invention relates to the forming of elongate structural components. More particularly though not exclusively it relates to the forming of aircraft structural components such as stringers.

In the case of an aircraft wing, stringers are attached to the wing skins and these stringer/skin assemblies in turn are jig assembled to ribs and spars to form a structural wing box. The wing surface is generally of complex double curvature shape and hence the stringers and wing skins have to be formed to achieve this contour.

The wings of large transport aircraft necessitate stringers of considerable scale, thickness and complexity such that it is quite impracticable for these to be incorporated into the wing structure and manually manipulated to conform to the desired curvature at that stage. Hence they must be accurately preformed to a given contour which is achievable as a function of three elements; vertical bend, lateral bend and axial twist. Currently, one known means of forming stringers requires the use of three operatives and the application of four-point bending by means of an hydraulic press and twisting by means of a specially designed hydraulic twisting machine. There are many shortcomings in this arrangement for various reasons. For example, the stringers which are typically machined from extruded aluminium billets may be significantly distorted by the machining operation which could complicate the subsequent preforming operation or at least require a preparatory adjustment stage. In any particular wing set there may be in excess of 100 stringer types, wide ranging in length, cross-sectional variation and generally dimensions. Thus the manual nature of this known pre-forming arrangement requires very strict limitations and guidelines as to how the stringers are to be formed which can be prohibitive in terms of cost and capacity.

UK Patent Specification No. 1,482,271 discloses a roll forming machine in which sheet metal structural elements may be formed to have multiplanar contours. In this machine the contour of the formed part is measured using a sensor, following the roll-forming process. The sensed contour is compared with a predetermined desired contour and correction signals are applied to the roll forming machine. In the disclosed arrangement the forming is effected by roll-forming and the process is not suited to elongate members which have a cross section which varies along their length. Aircraft stringers may not be susceptible to roll forming; for example they may be machined out of a solid billet of material and may have various cut-outs or pads extending in or attached to the flanges of the stringer. Also, in the arrangement disclosed in 1,482,271, the counter is measured only after the forming process and thus it may well be necessary to pass the structure through the forming machine several times.

European Published Application No. 127,935 discloses a bending and straightening apparatus for straightening a rail way line rail. The rail is subjected to a three-point bending process during which the load applied and the displacement of the rail are measured to determine the point at which the plastic component of the total displacement is equivalent to the required deformation, and the load is then removed. In this arrangement the apparatus is capable only of three-point bending and the deflections applied are contained in a single plane. Moreover, the apparatus is designed and intended for straightening isolated portions of a curved rail, and there is no suggestion that it could be used to apply complex, multiplanar bending and twisting deflections.

According to one aspect of this invention, there is provided apparatus for forming an elongate structural member, such as stringer, to have a predetermined contour, said apparatus including forming means operable in use to apply permanent set deflections to an elongate structural member and control means operable to control said forming means to apply permanent set deflections in accordance with said predetermined contour, characterised in that said forming means comprises manipulating means operable in use to engage an increment of the length of the elongate structural member, said manipulating means including a plurality of manipulator heads operable in use to engage respective longitudinally spaced portions of said increment, sensor means associated with at least some of said heads operable in use to provide data representing the contour of an increment engaged by said head, curvature forming means operable in use to effect relative movement of said minipulator heads to apply a bending moment to at least part of said increment, and twist forming means operable in use to effect relative movement of said manipulator heads to apply torsion to at least part of said increment.

According to another aspect of this invention, there is provided a method of forming an elongate structural member, such as a stringer, to have a predetermined contour, said method comprising applying to said elongate structural member of a manipulator means capable of determining the contour of an increment of the length of the elongate structural member engaged by said manipulator means and applying to said increment permanent set deflections in the twist sense and in at least one bending sense, subjecting the increment of the structural member to a manipulator step in which the contour of the increment of the length of the elongate structural member is determined and at least one permanent set deflection is applied to said increment in accordance with the predetermined contour, advancing the manipulator means relative to said workpiece to engage a further increment, and repeating said manipulation step and said advancing to cause the elongate structure to adopt the predetermined contour.

In the embodiments described below, an elongate structural member is formed to have a predetermined profile by applying a manipulator to grip a selected increment of the length of said structural member, measuring the initial contour of said increment, comparing the measured contour with the desired contour and applying to the increment sufficient bending moment and torsion to apply a permanent set deflection in accordance with the desired contour. Following the bending and twisting operations the structural member is advanced relative to the manipulator and the measuring, twisting and bending operations are repeated until the elongate structural member has the required contour.

Certain preferred embodiments of the invention will now be described, by way of example, with reference to the accompanying drawings, in which:

FIGS. 1*a* and 1*b* illustrate typical aircraft stringers in their unformed state;

Figure 4A:
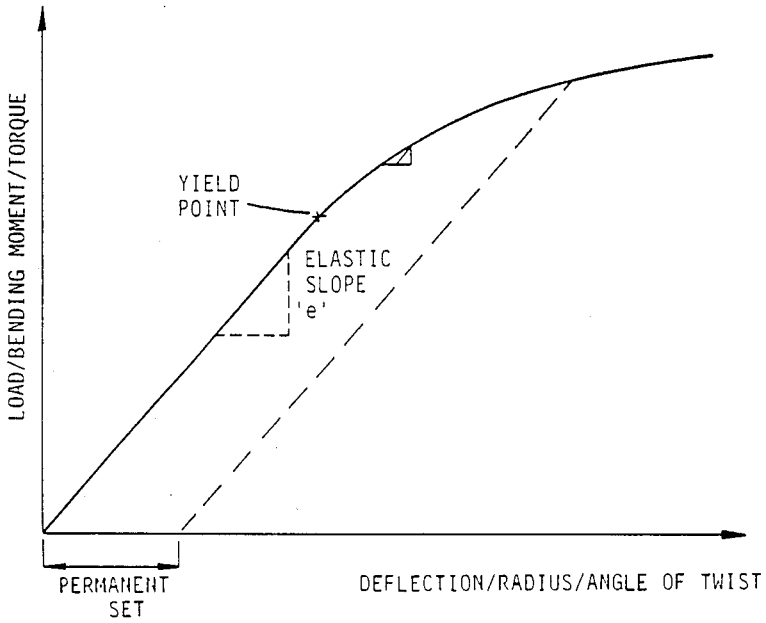
Figure 4B:
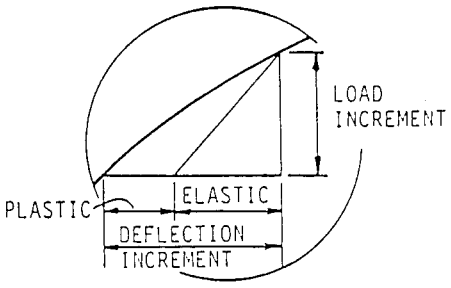
Figure 5:
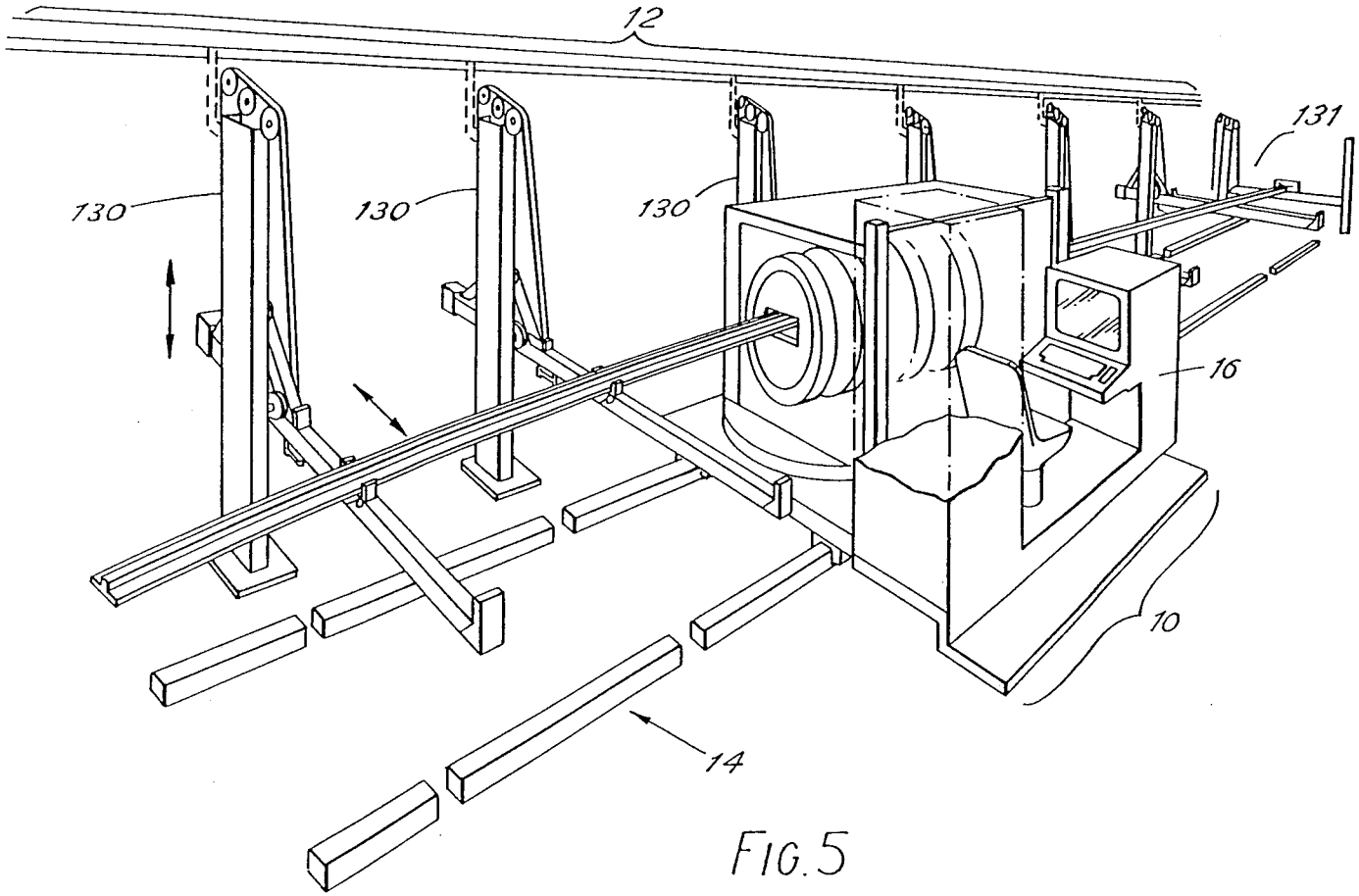
Figure 6:
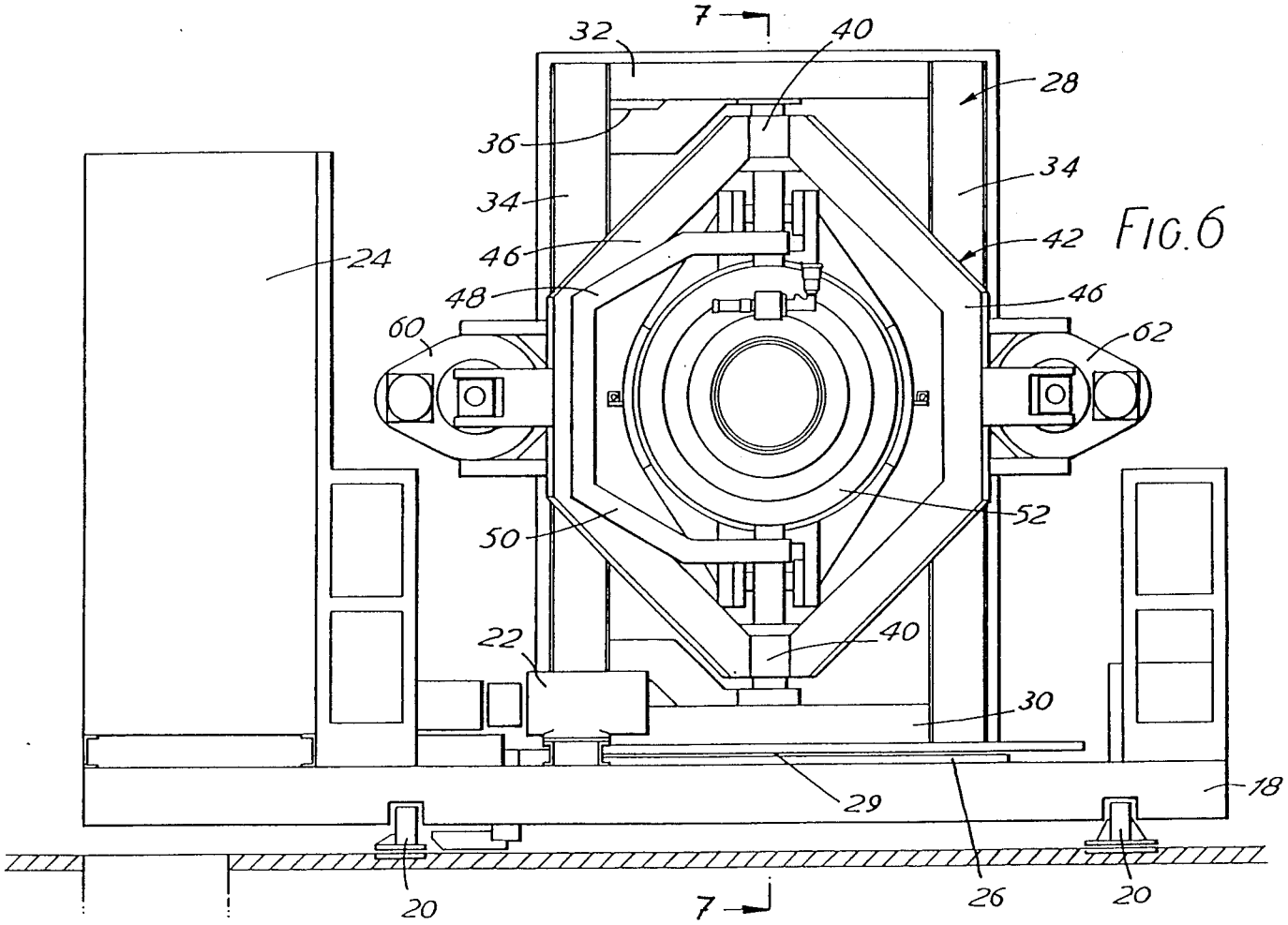
Figure 7:
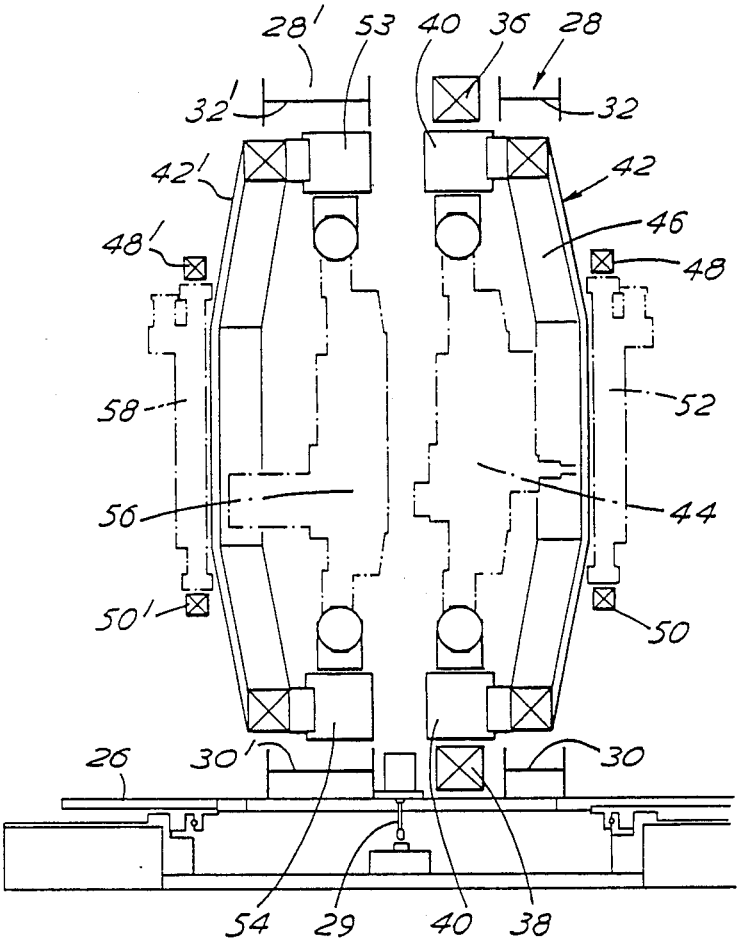
Figure 8:
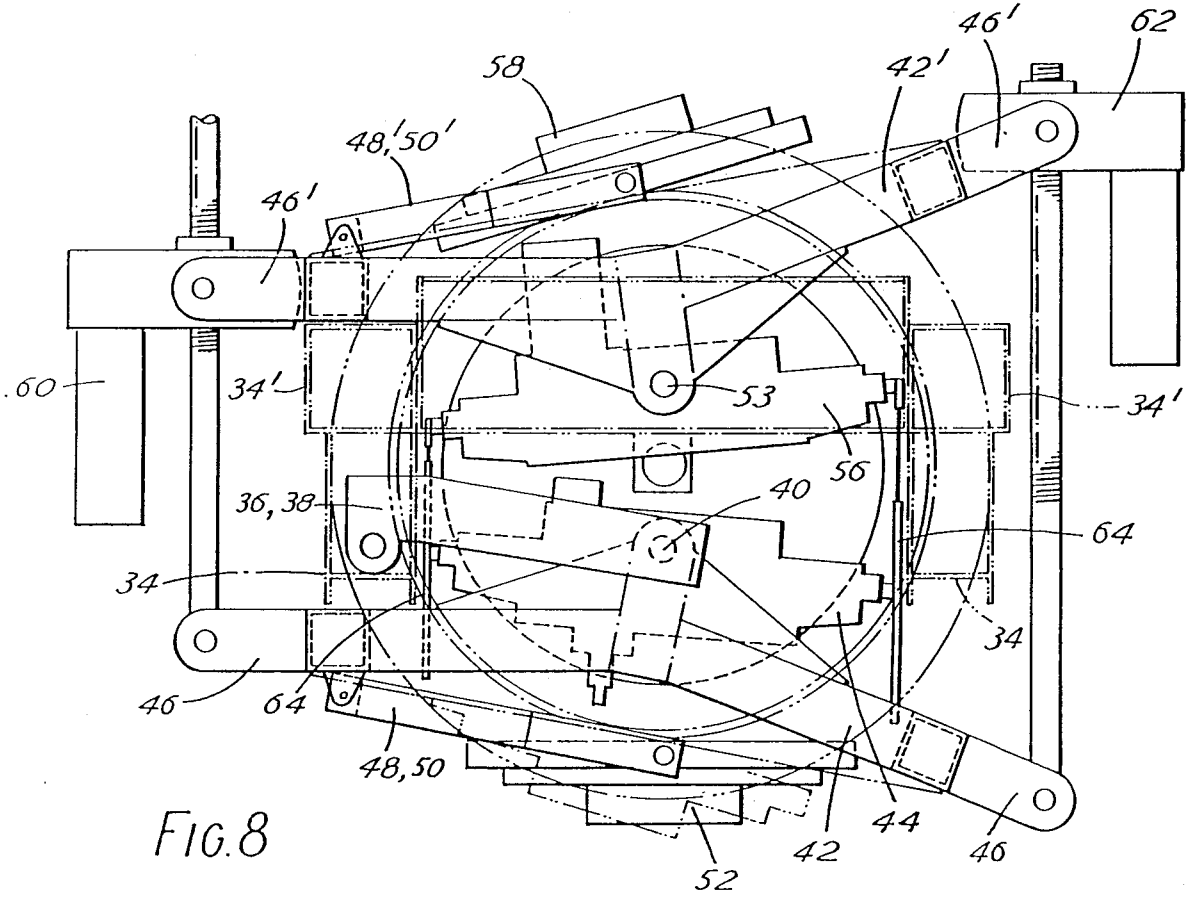
Figure 9A:
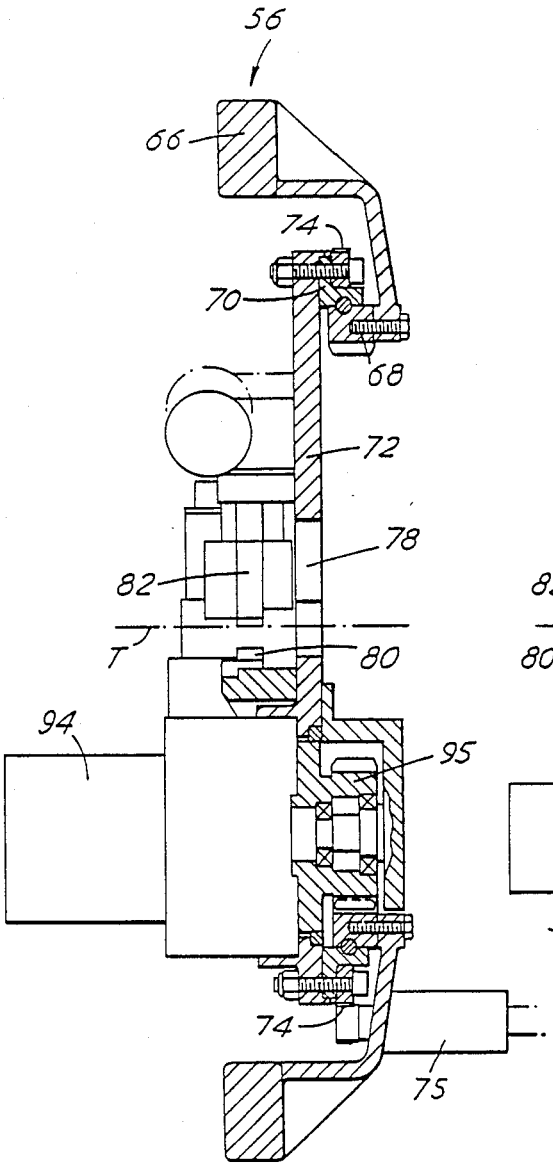
Figure 9B:
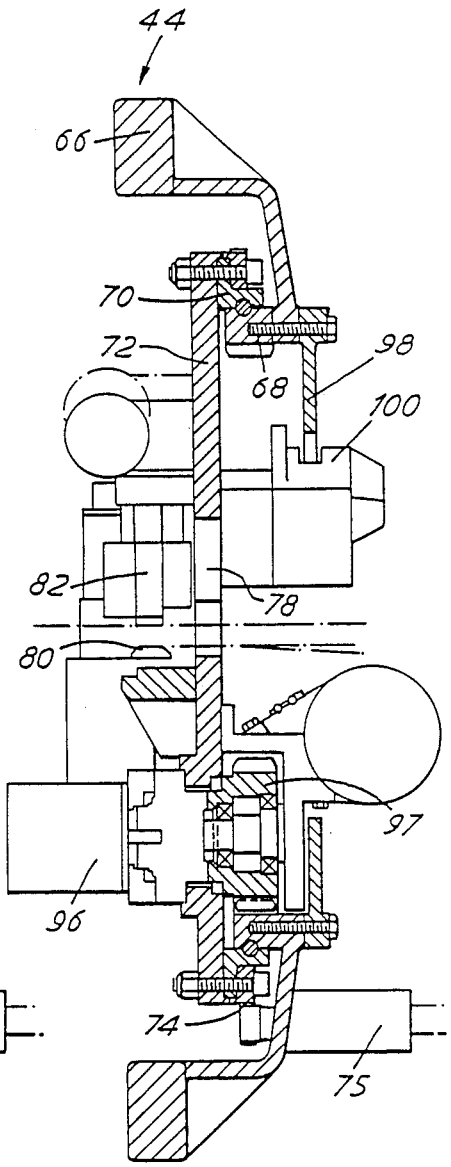
Figure 10:
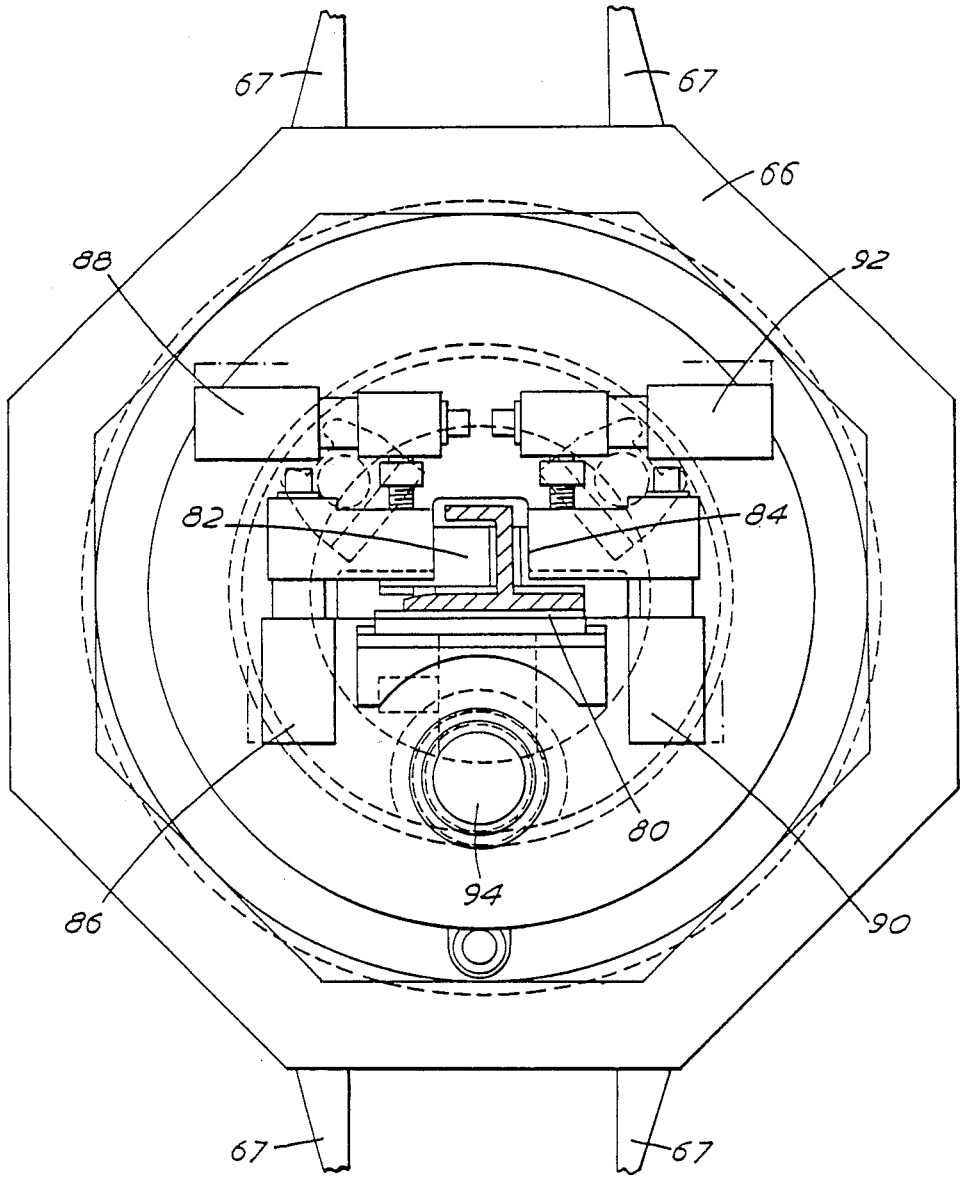
Figure 11:
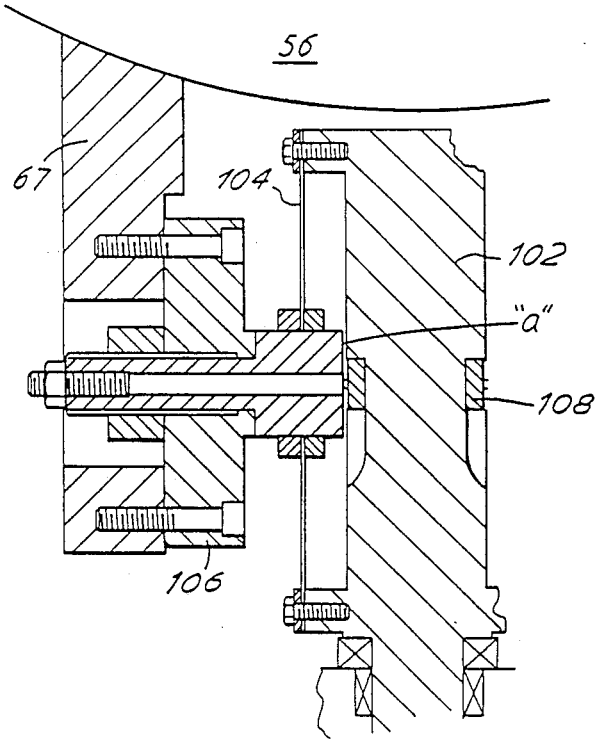
Figure 13:
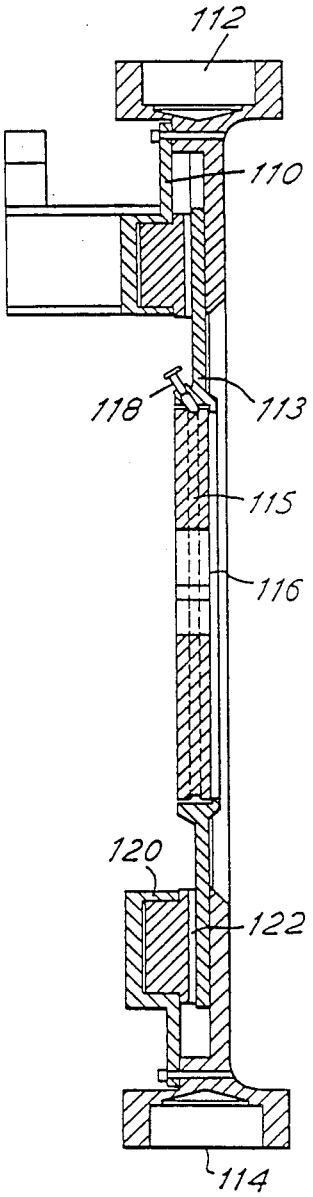
Figure 12:
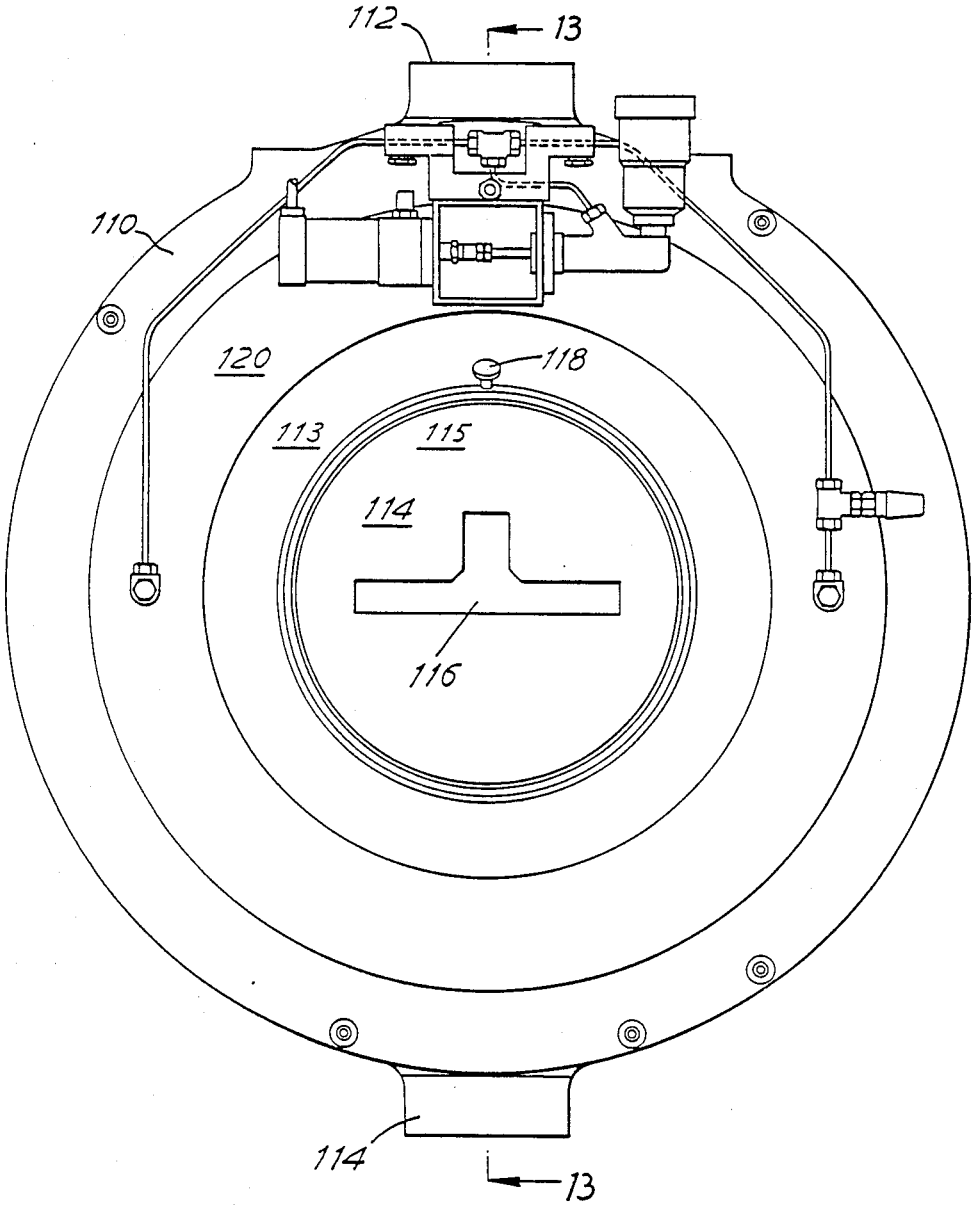
Figure 15A:
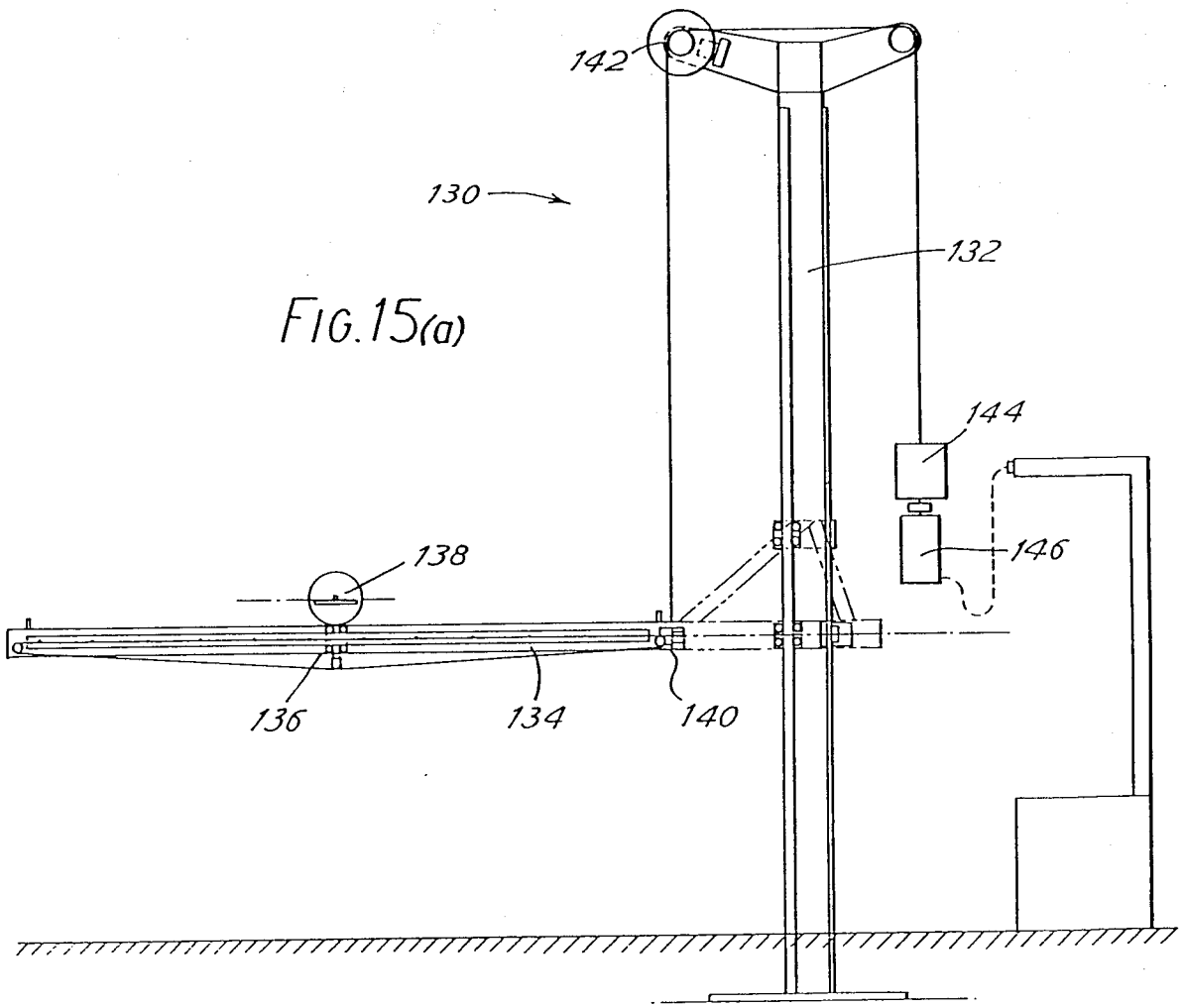
Figure 15B:
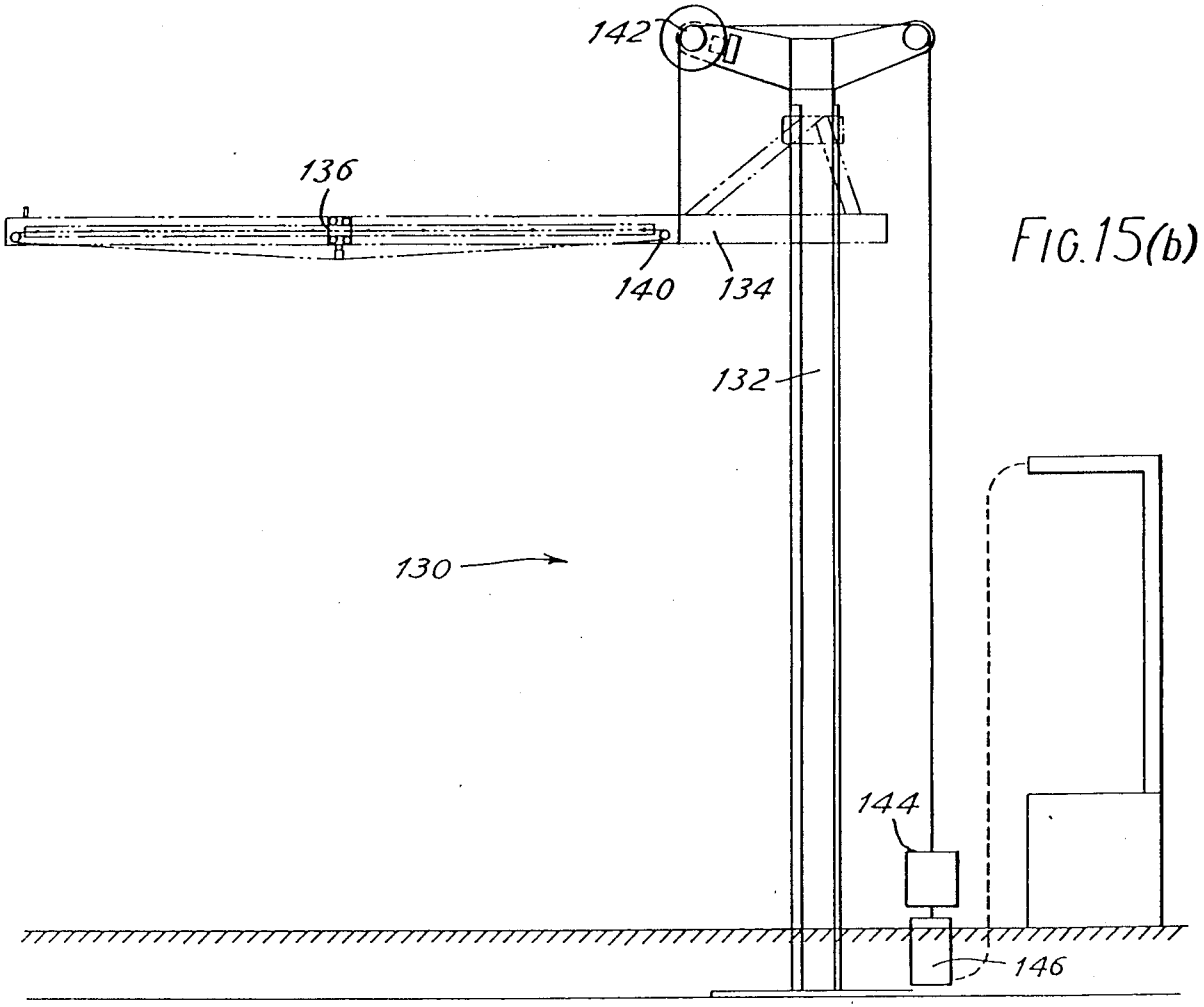
Figure 15C:
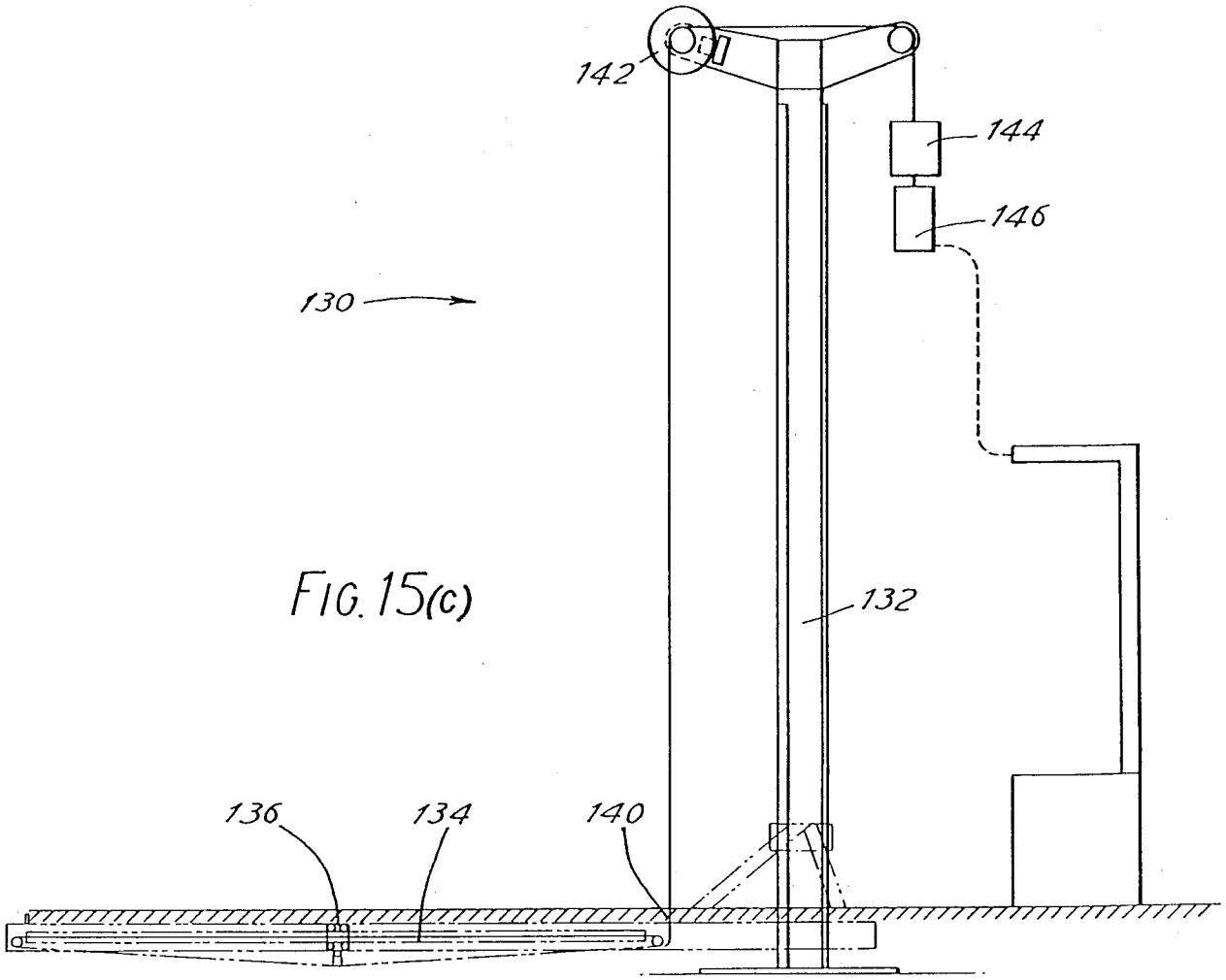
Figure 16:
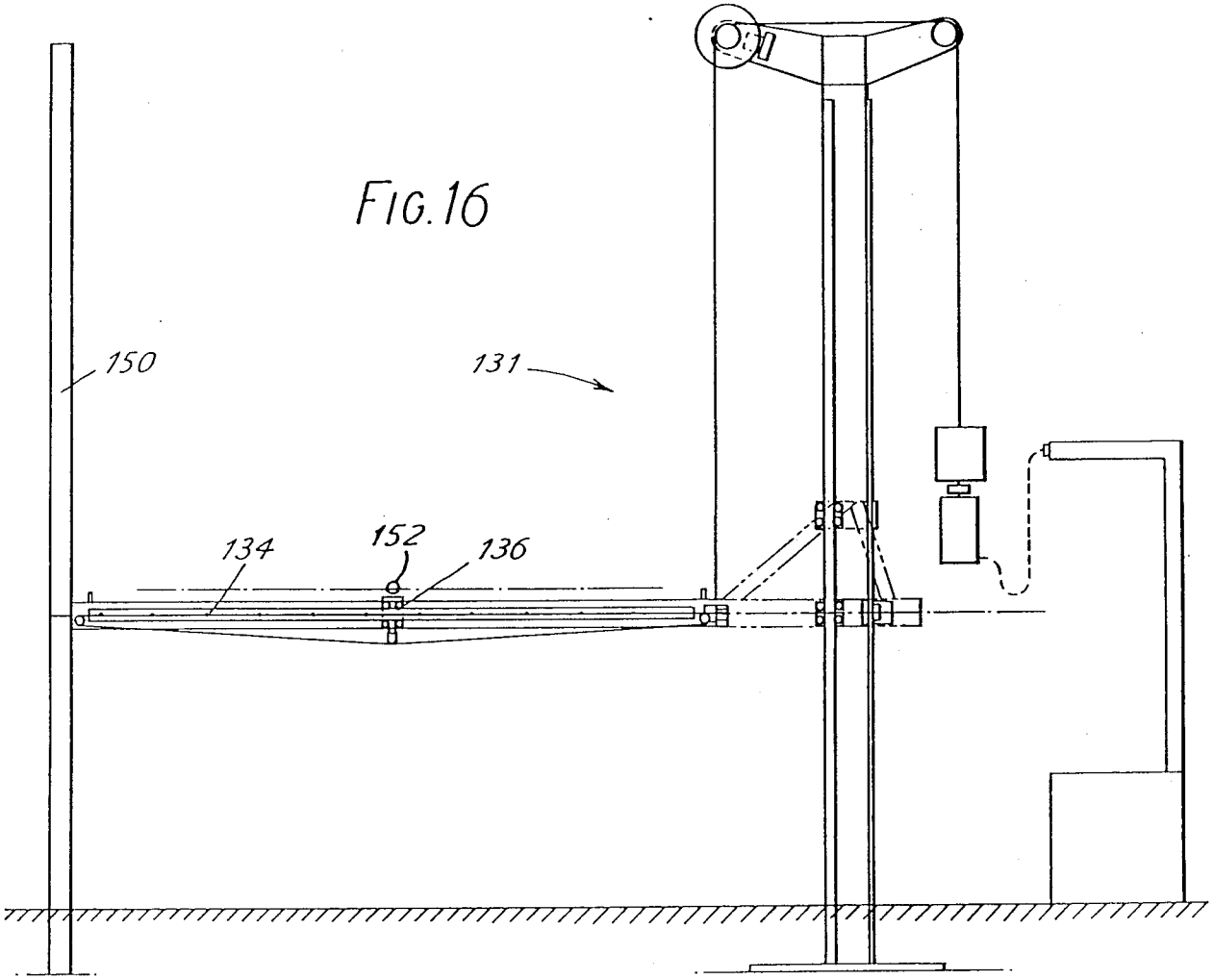

FIGS. 4*a* and 4*b* illustrate graphically the permanent set algorithm used in the method of the present invention;

FIG. 5 is a general arrangement of the stringer forming facility of a first embodiment of the present invention;

FIG. 6 is an end view of the manipulating system of the stringer forming facility of FIG. 5;

FIG. 7 is a side section view of the manipulating system taken on lines VII—VII of FIG. 6;

FIG. 8 is a top plan view of the manipulating system of FIGS. 6 and 7;

FIGS. 9*a* and 9*b* are a detail side section view of part of the torsion and brake clamp heads of the manipulating system of FIG. 6;

FIG. 10 is an elevation view of part of the brake clamp head illustrated in FIG. 9;

FIG. 11 is a detailed view of the load cell arrangement employed in the torsion clamp head of FIG. 9;

FIG. 12 is an elevation view of part of one of the reaction heads of FIG. 9;

FIG. 13 is a section view taken on lines XIII—XIII of FIG. 12;

FIGS. 14(*a*) and (*b*) are diagrammatic views showing the first embodiment manipulation system head when in a straight configuration and a bent configuration respectively;

FIGS. 15(*a*), (*b*) and (*c*) are schematic views of a workpiece support stand of the facility of FIG. 5 in a typical operating position, an uppermost position and a "run over" position respectively;

FIG. 16 is a schematic view of an end support stand of the facility of FIG. 5.

Figure 17A:
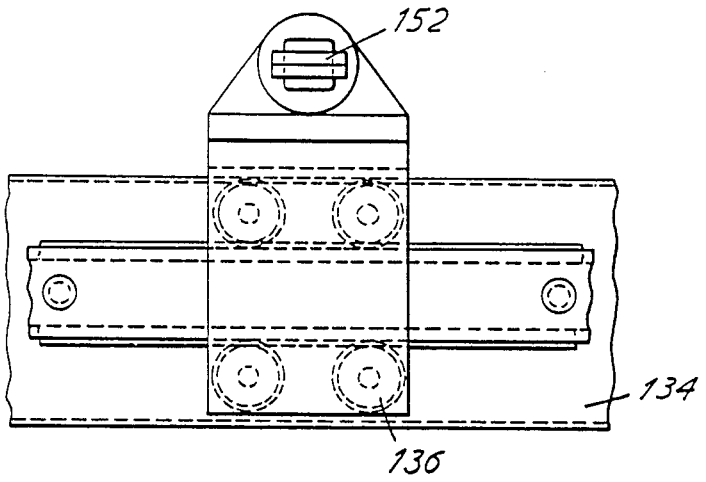
Figure 17B:
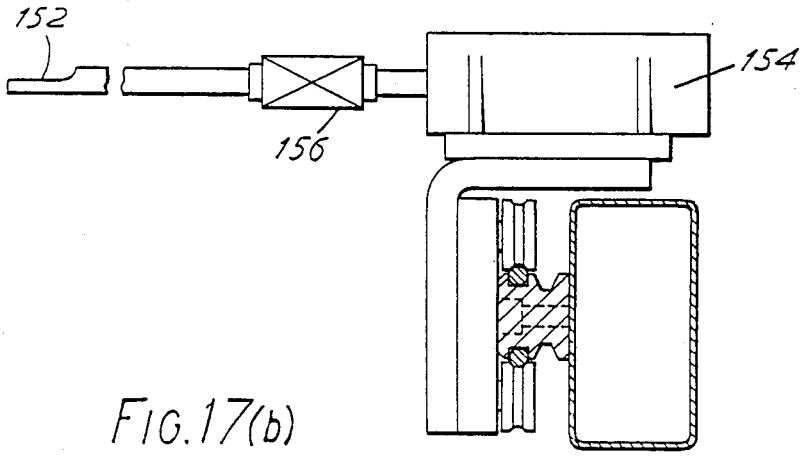
Figure 18:
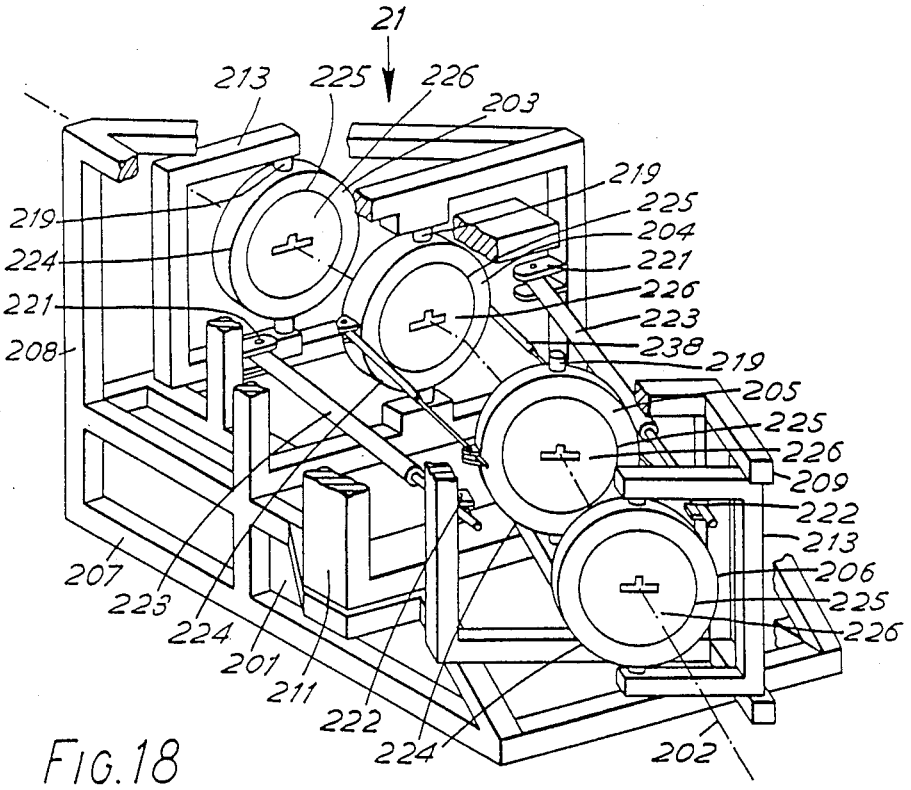
Figure 24:
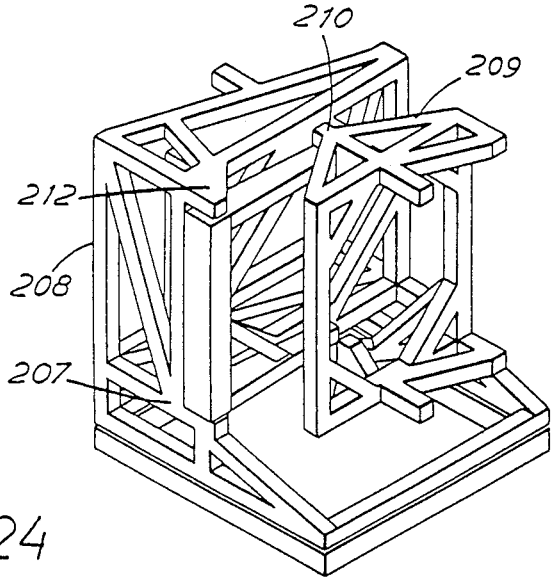
Figure 19:
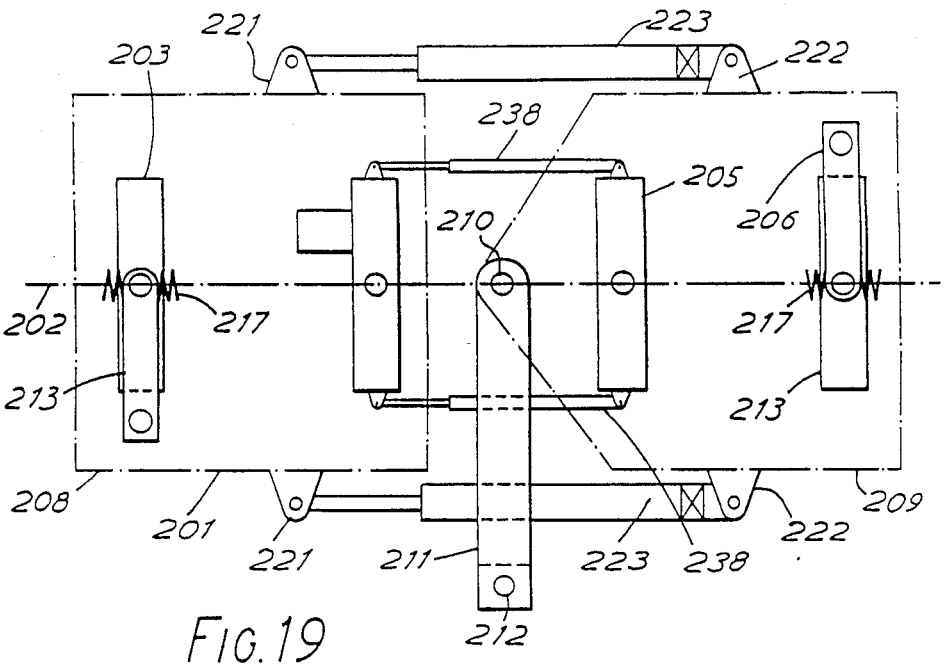
Figure 20:
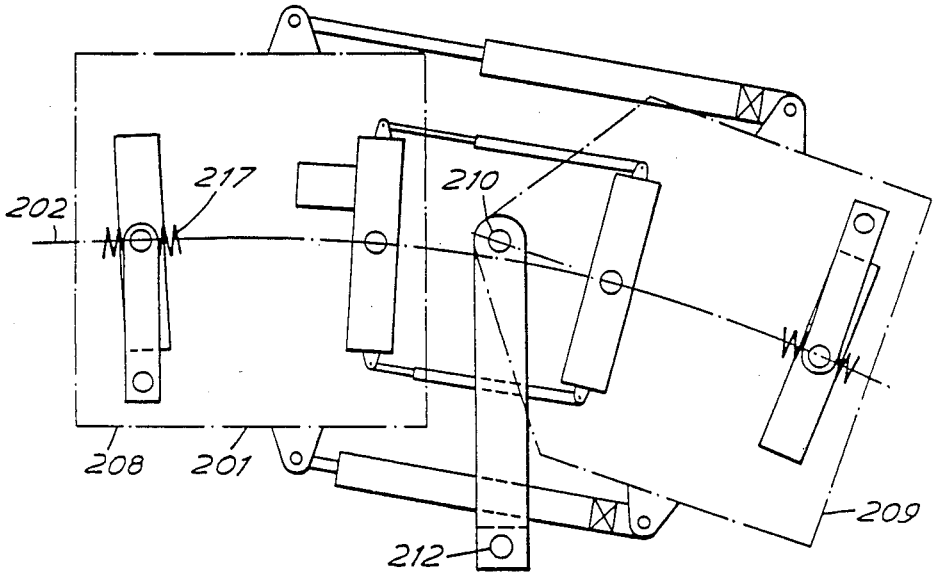
Figure 21:
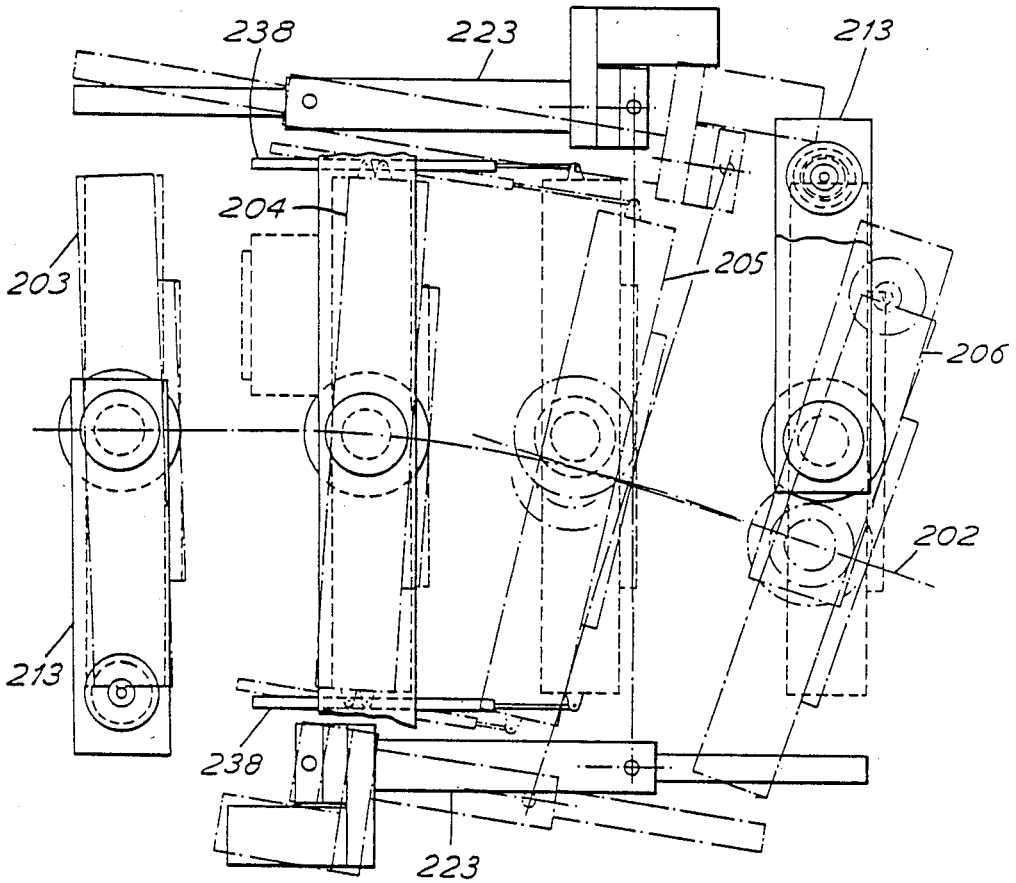
Figure 22:
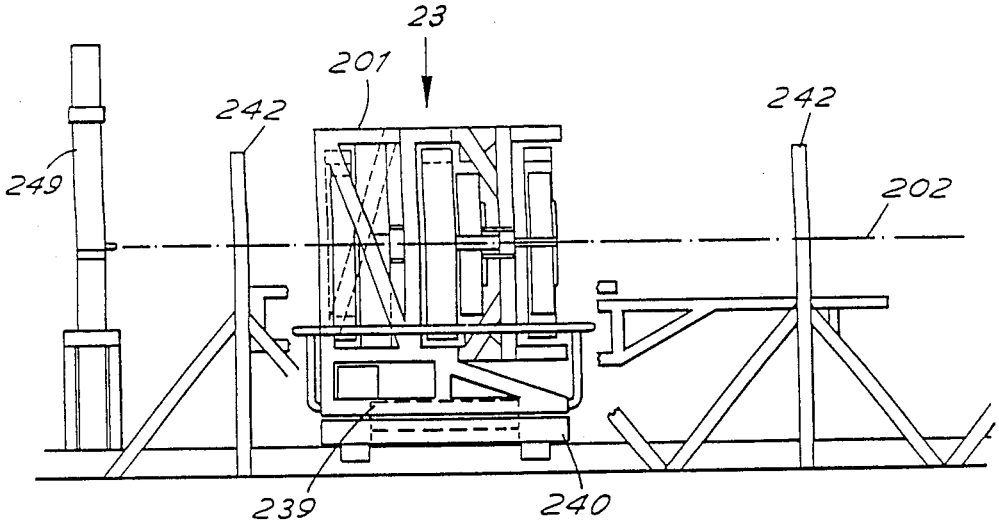
Figure 23:
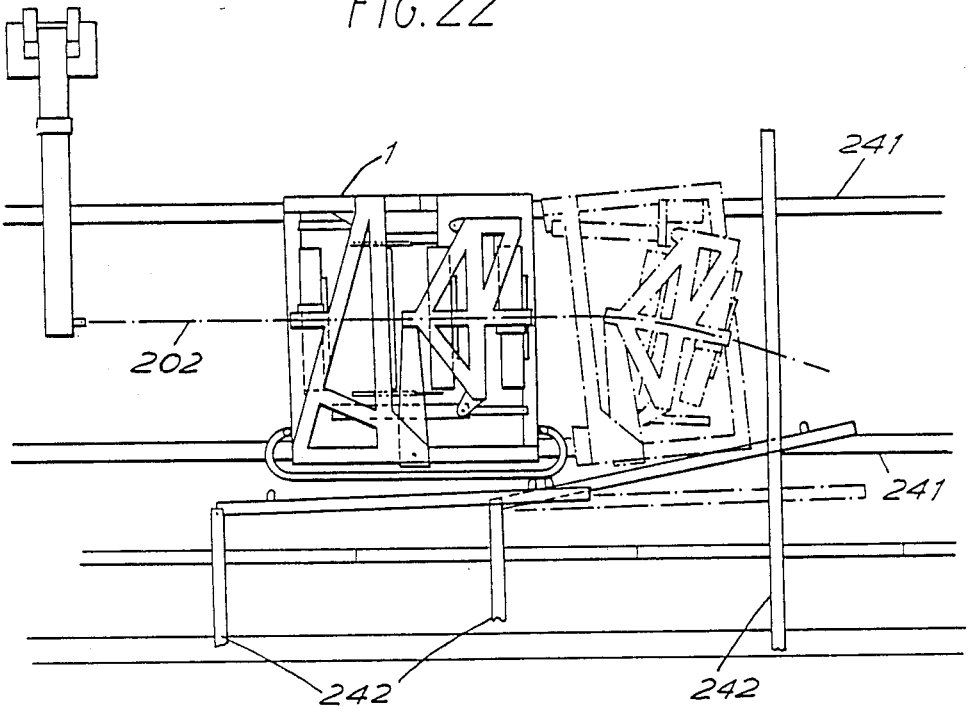
Figure 26:
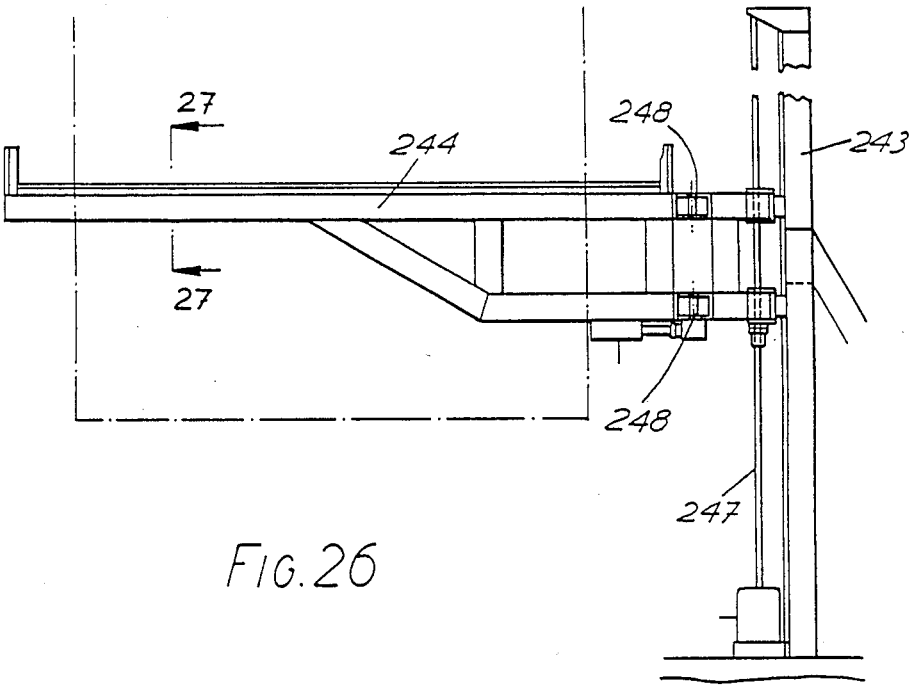
Figure 27:
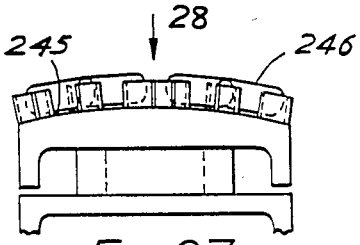
Figure 25:
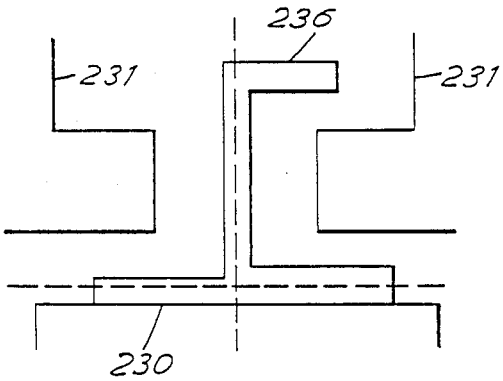
Figure 28:
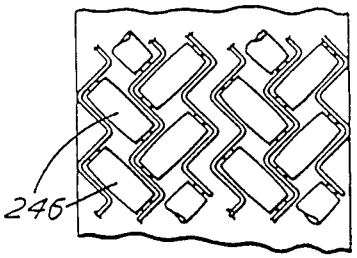
Figure 29:
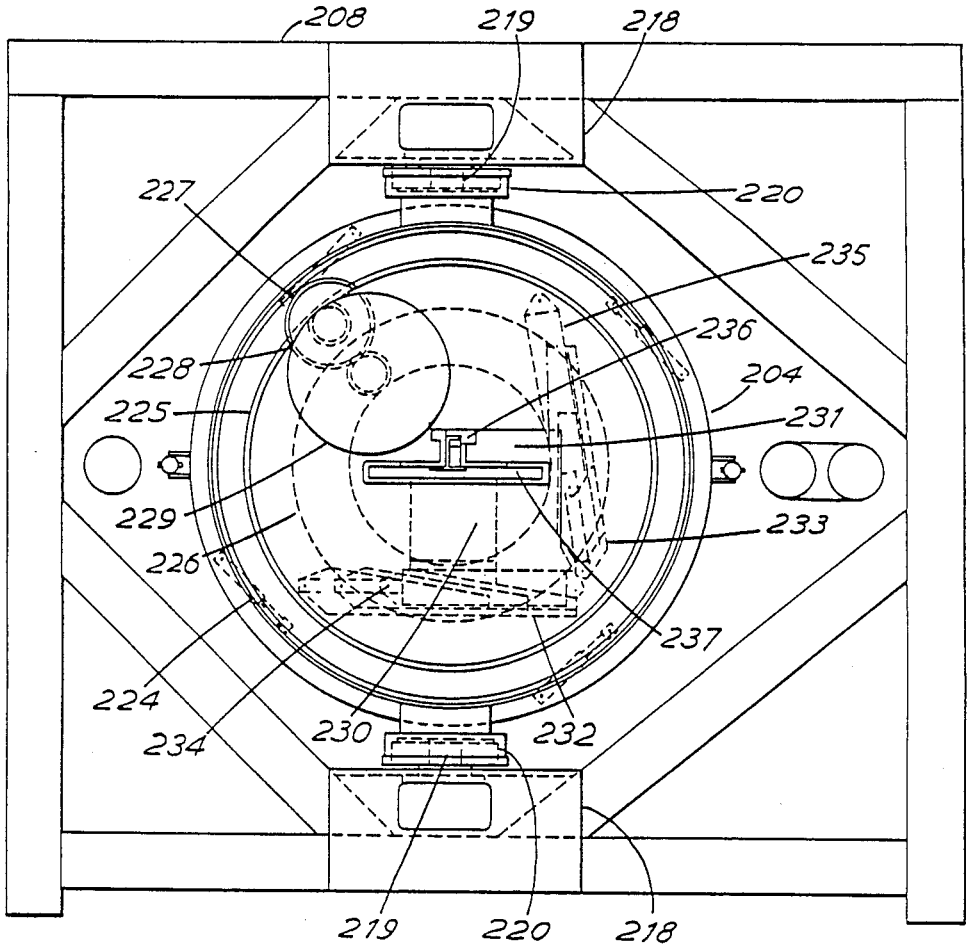
Figure 30:
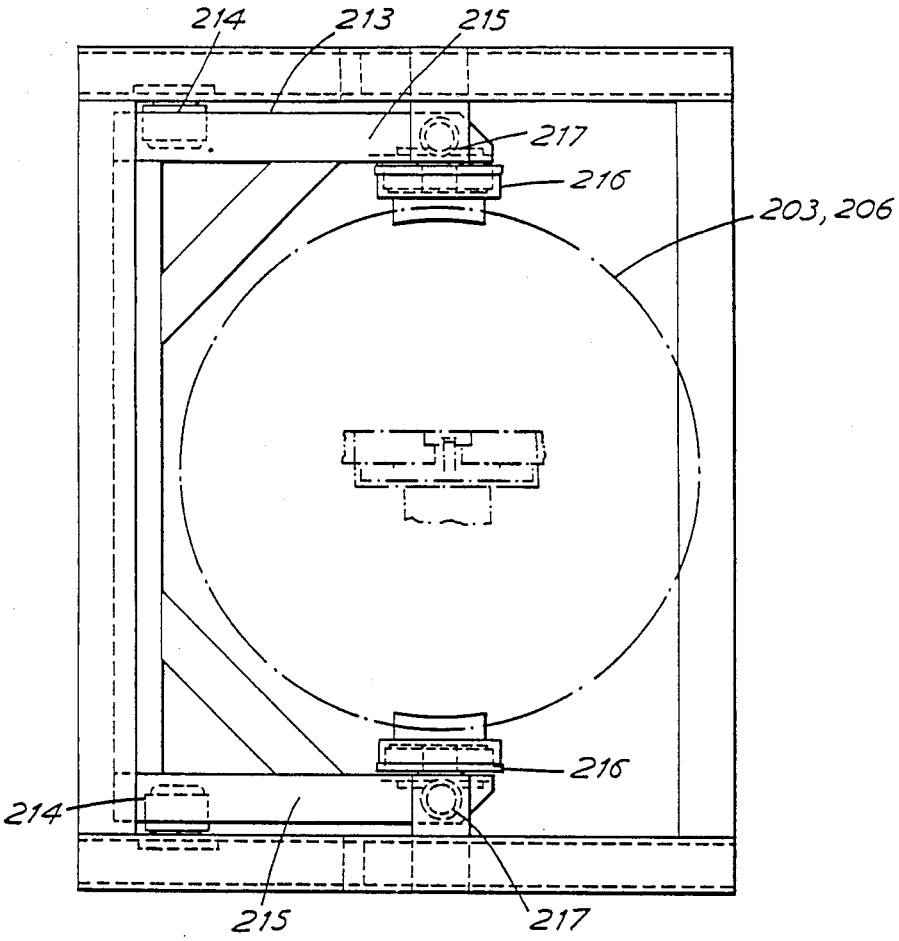

FIGS. 17(*a*) and (*b*) are longitudinal and section views respectively of the stringer anchor device for the end support stand of FIG. 18;

FIG. 18 is an isometric arrangement of the stringer manipulation apparatus for use in a stringer forming facility according to a second embodiment of the present invention;

FIG. 19 is schematic plan view arrangement of the stringer manipulation apparatus of FIG. 18;

FIG. 20 is a schematic plan view arrangement of the apparatus of FIG. 18 depicting the stringer manipulation phase;

FIG. 21 is a schematic plan view of the apparatus of FIG. 18 in the direction of arrow XXI in FIG. 18;

FIG. 22 is an elevation on a typical stringer manipulation facility in accordance with the second embodiment of the invention;

FIG. 23 is plan view on the facility of FIG. 22 in the direction of arrow XXIII;

FIG. 24 is an isometric arrangement of the manipulating head apparatus of FIG. 18;

FIG. 25 illustrates diagrammatically a typical clamping sequence at the manipulation apparatus of FIG. 18;

FIG. 26 illustrates an elevation on a stringer support structure of the facility of FIG. 9;

FIG. 27 is a typical section through the support structure in the direction of arrows XXVII—XXVII in FIG. 26;

FIG. 28 is a plan view on the support structure in direction of XXVIII in FIG. 27;

FIG. 29 is an elevation on a driving head of the embodiment of FIG. 18;

FIG. 30 is an elevation on a typical clamping head of the embodiment of FIG. 18.

Figure 1A:
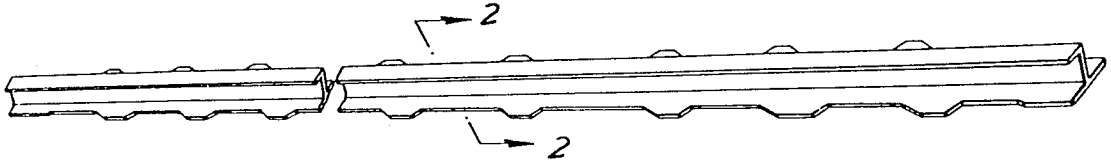
Figure 1B:
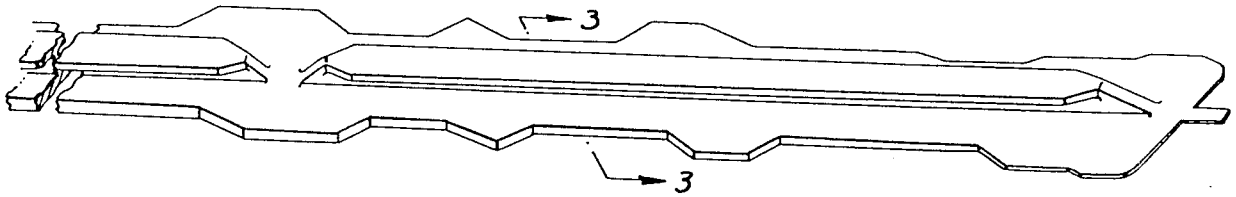
Figure 2:
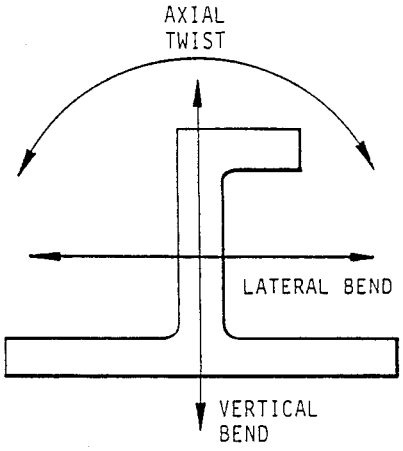
FIG. 2 is a section through one typical aircraft stringer in the direction of arrows II in FIG. 1.
Figure 3:
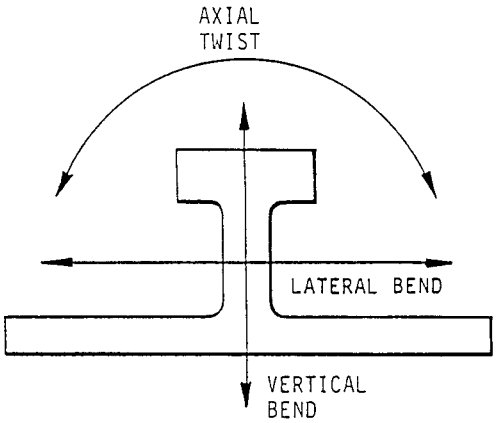
FIG. 3 is a section through a further example of aircraft stringer in the direction of arrows III in FIG. 1.

Referring to the drawings, FIG. 1 illustrates two typical examples of aircraft stringer machined from billets of aluminium alloy material which in their machined form, will be of a predetermined cross-section in accordance with structural requirements. Typical cross sections are illustrated in FIGS. 2 and 3 but these may vary in dimension and form along the length of the stringer which, in the case of large transport aircraft wings, may be in excess of 50 feet (15.25 meters). In the 'as machined' condition, as illustrated, the stringers will be substantially flat although significant distortion may arise as a result of the machining operation when the components are released from the machine tool.

In the case of an aircraft wing, the wing surface is a complex double curvature shape and hence each stringer has to be formed to achieve the desired contour in it intended location. This contour may consist of three forming elements, as depicted in FIGS. 2 and 3, namely vertical bend, lateral bend and axial twist. To achieve the desired final configuration, each stringer must be subjected to controlled incremental loading in accordance with these forming elements. As is well known, a member, such as a stringer, loaded to a value below the yield point of the material will unload with no permanent deflection. When taken to a load greater than the yield point value, it will unload along a line parallel to the loading line. The separation of the lines is the amount of permanent set achieved. The permanent set algorithm, in respect of the present system, is discussed with reference to FIG. 4. The Figure shows a typical load/deflection curve. This can be either a bending moment/radius of curvature or torque/angle of twist curve. The curve comprises a linear or elastic part and a plastic part where the deflection is due to further elastic deflection and a plastic or permanent deflection. The point separating the two parts of the curve is the yield point.

In manipulating the stringer in the required form in the present embodiment the steps are as follows:

1. The stringer is loaded up to the yield point in small increments of load.
2. The value of elastic slope is determined by a least squares best fit using load and deflection attained at each load increment.
3. The stringer is further loaded and the amount of plastic deflection or permanent set is determined for each load increment.
4. Step 3 is repeated adding successive increments of plastic deflection until the amount of permanent set required is reached.
5. The stringer is unloaded and the amount of permanent set checked.
6. Steps 1 to 5 are repeated at a number of points along the stringer until the stringer as a whole conforms to the required contour.

Referring to FIG. 5, the first embodiment of automated stringer forming facility comprises a manipulating system 10, a support system 12 and a positioning system 14 each under the control of a control system 16. These constituent parts will now be described separately.

Manipulating System (FIGS. 6 to 14)

The manipulating system 10 comprises a multiheaded manipulator by which controlled permanent set deflections in one or more of the axial twist, vertical bend and lateral bend senses may be applied to an elongate workpiece. The manipulating system comprises a base frame 18 which runs along a pair of rails 20 set in the floor and which supports a drive system 22 (e.g. chain and sprocket) for moving the manipulator back and forth along the facility. The base frame 18 includes an operator's console 24 housing the control system 16 and supports a turntable 26 which carries a main frame generally in the form of two spaced portal frames 28, 28'. A position encoder 29 outputs data identifying the rotational position of the turntable. The portal frames 28, 28' include a horizontal base member 30, 30' upper horizontal members 32, 32' and vertical side members 34, 34' respectively.

Referring to FIGS. 6, 7 and 8, one of the side members 34 of the right hand portal frame 28 (as viewed in FIG. 7) pivotally supports upper and lower side support links 36, 38 respectively for movement about a vertical axis. At their ends remote from the attachment to the side member 34, the upper and lower support links 36, 38 carry by means of trunnion arrangements 40 a swinging frame 42 for movement about a vertical axis. The trunnion arrangements also support, within the swinging frame 42, an inner clamp head 44 whose construction and operation will be described in detail below. The swinging frame 42 is cranked about the trunnion arrangement as viewed in plan and is made up of two side frame members 46 together defining a hexagonal frame.

The left hand side frame member 46 (as viewed in FIG. 8) of the swinging frame 42 pivotally supports upper and lower side links 48, 50 which pivotally carry, at their ends remote form the side frame member, an outer reaction head 52. The pivotal connection includes a spring centering arrangement to allow a degree of float in the sense parallel to the workpiece axis.

The left hand portal frame 28' (as viewed in FIG. 7) mounts, by means of a lower and an upper trunnion arrangement 53, 54 in the horizontal base member 30 and the upper horizontal member 32 respectively, a swinging frame 42' for pivotal movement about a vertical axis. The trunnion arrangements also serve to support an inner clamp head 56 for movement about a vertical axis. The construction and operation of the clamp head will be described in detail below. The swinging frame 42' is of similar shape and construction as swinging frame 42. Likewise, upper and lower side links 48', 50' are pivotally supported on a side frame member 46' of the swinging frame 42' and pivotally carry an outer reaction head 58.

The swinging frames 42 and 42' are interconnected by two electrically driven screwjack arrangements 60, 62, each incorporating a lead cell and being operable to draw together or urge apart the swinging frames, thus applying a bending moment to a workpiece held by the manipulator. Each jack arrangement 60, 62 interconnects the mid portion of one of the side frame members 46 with the mid portion of the corresponding side frame member 46' of the other swinging frame. The separation and relative orientation of the inner clamp heads 44 and 56 is sensed by linear (LVDT) transducers 64, which interconnect opposed portions of the clamp heads as seen in detail in FIG. 8.

Referring now particularly to FIGS. 9 and 10, the clamp heads 44 and 56 are generally similar in construction and each serves to grip a portion of an elongate structural workpiece and apply or react a bending moment or a torsion to the workpiece. A primary difference between the clamping heads is that clamp head 56 includes a torque motor 94 to impart torsion to a workpiece whilst clamp head 44 includes an hydraulic brake 100 to react the torsion transmitted to the clamp head via the workpiece. For each of description, therefore, the clamp head 56 is referred to herein as the torsion clamp head and the clamp head 44 is referred to as the brake clamp head.

Each head includes an outer octagonal frame 66 (see FIG. 10) having an upper and a lower pair of spaced parallel lugs 67 for being attached to the respective trunnion mountings on the swinging frame 42, 42' via load cell mountings as to be described below. Each frame 66 is fixed to an annular rack section 68 (see FIG. 9), the inner surface of which is provided with teeth and the outer surface of which forms an inner race for a bearing assembly 70 which supports a clamp plate 72 for rotary movement about a central axis T. The bearing assembly also includes an outwardly directed toothed drive surface 74 which cooperates with a position encoder 75 to output data representing the rotary position of the clamp plate 72.

Each clamp plate 72 includes a central aperture 78 large enough to accommodate the largest section of the elongate structure that will be required to be formed using the manipulator. The clamp plate includes a fixed datum clamp member 80 and two movable angled clamp members 82 and 84 each being independently movable in two orthogonal directions by means of electric actuators 86, 88 and 90, 92 respectively. The surfaces of the clamp members which contact the workpiece in use are covered with a suitable plastics or other protective material such a Tufnol (Trade Mark) to prevent damage to the workpiece.

The torsion clamp head 56 includes a torque motor 94 incorporating a gear box and secured to the clamp plate 72 and driving a gear 95 which engages the toothed surface of the rack section 68 to allow the torque motor 94 to apply torque to a workpiece clamped in the torsion clamp head.

The brake clamp head 44 includes a motor 96 secured to the clamp plate 72 and having a gear 97 engaging the rack section 68. In the case however of the brake clamp head, the motor 96 is intended merely for motoring the head to adjust its rotary position rather than for applying torque. The design and construction of the motor 96 is thus different form torsion motor 94. The brake clamp head 44 also differs in construction from the torsion clamp head 56 in that it includes an annular brake disc 98 fixed to the octagonal frame 66 and an hydraulic brake caliper 100 mounted on the clamp plate 72. The brake caliper is operable to clamp the brake disc thus braking the clamp plate against movement and transmitting torsion applied thereto to the octagonal frame.

Reference is now made to FIG. 11 which illustrates the load cell arrangements employed in the torsion clamp head 56. The arrangements employed in the brake clamp head 44 are generally similar but differ in certain material aspects. The purpose of the load cells is to measure both the applied bending moment and the applied torque on the workpiece being formed. It will be understood that the forces required and generated in bending are typically much greater than those required for torsion. In the present arrangement, the torsion applied to the workpiece is measured by measuring the torque between the brake clamp head 44 and the swinging frame. Consequently the load cell arrangement on the brake clamp head will be required to measure loads generated by bending and by torsion. In order to give the range and resolution required, the load cell arrangement on brake clamp head 44 comprises two sets of cells; low range cells (0-about 500 lbs; 0-about 2.2 kN) intended primarily to measure torque loads and high range cells (0-about 7000 lbs; 0-about 31 kN) to measure the bending lads. The arrangement illustrated allows the low range cells to "bottom out" against a shoulder so that the load path bypasses the low range cells at loads higher than a given threshold.

As described above, each of the clamp heads 44, 56 includes an upper and a lower pair of lugs 67. In FIG. 11 only one lower lug is shown, it being readily appreciated that the arrangement of FIG. 11 is symmetrical about the vertical centre line A. The arrangement for the upper pair of lugs is the same. In FIG. 11, the trunnion axle 102 (by which the clamp head is pivotally attached to the swinging frame 42 or 42') is located centrally between the lower lugs 67 (only one of which is shown). Loads in a plane normal to the clamp plate 72 are transferred from the lugs of the clamp head to the trunnion axle by means of a thin stainless steel diaphragm 104. A 'pancake' load cell 106 is secured to each lug 67 and engages a small button load cell 108 on the trunnion axle. The gap "a" between the end of the pancake load cell and the housing of the small button load cell is set such that the gap closes when the button load cell is fully loaded, thus diverting the load path.

It will be appreciated that the stainless steel diaphragm 104 transmits the weight of the head and any resultant load to the trunnion axles. The diaphragm does not significantly impair the measurement of the lateral load. The trunnion axles 102 rotate with the clamp head so that loads are always measured in the plane of the clamp head.

The arrangement described above applies to both the top and bottom load cell/trunnion arrangements for the brake clamp head 44.

The torsion clamp head 56 has a simpler arrangement; since there is no requirement for measuring torque loads in this head, there are no button load cells and no diaphragms and the pancake load cell 106 is bolted directly to the trunnion axle and transfers the loads previously transferred by the diaphragms as well as performing its bending load measuring function.

As to be discussed later, the manipulator may be used to implement three-point as opposed to four-point bending and, for this reason the ratings of the load cells on the torsion clamp head 56 are double those of the brake clamp head 44.

Referring now to FIGS. 12 and 13, each of the reaction heads 52 and 58 comprises an outer disc 110 with upper and lower gimbal mountings 112, 114 for pivotal connection to the upper and lower side support links 36 and 38 respectively. The disc 110 includes a cavity which receives a floating plate 113 with sufficient clearance to allow significant floating movement in the plane transverse to the workpiece axis. The floating plate 113 includes a central circular aperture which rotatably receives disc 115 with an aperture 116 generally matching the section of the workpiece. The disc 115 is formed of a tough nylon or plastics material e.g. Tufnol (Trade Mark) and is held in the plane of the floating plate by three index pins 118. The outer disc includes an hydraulically operated annular piston/cylinder arrangement comprising a pneumatic/oil system annular piston 120 having a disc pad 122 for contacting and gripping the floating plate. In use, the piston 120 may be released to allow the floating plate to float in the transverse plane and actuated to lock the plate in a particular transverse position. Once the floating plate has been locked, it will be appreciated that the disc 115 is still capable of rotation. This feature allows bending loads to be reacted by the reaction heads, but also allows the workpiece to rotate relative to the reaction head.

It should be noted that, when a workpiece is bent, the effective distance between its end decreases thus giving an apparent "pull-in" effect. This is overcome by allowing a degree of float provided by means of a spring centering arrangement (not shown).

Figure 14A:
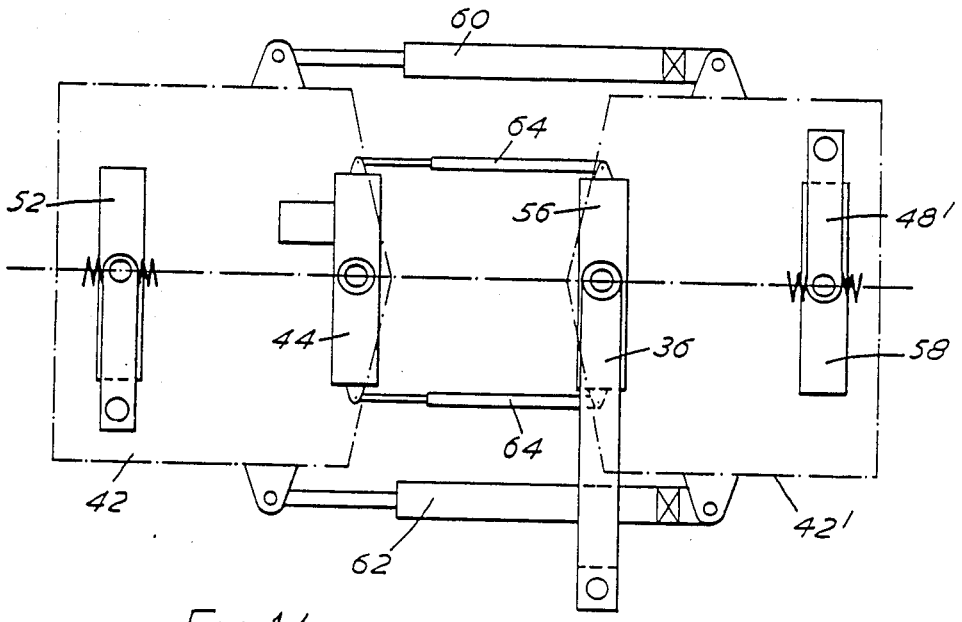
Figure 14B:
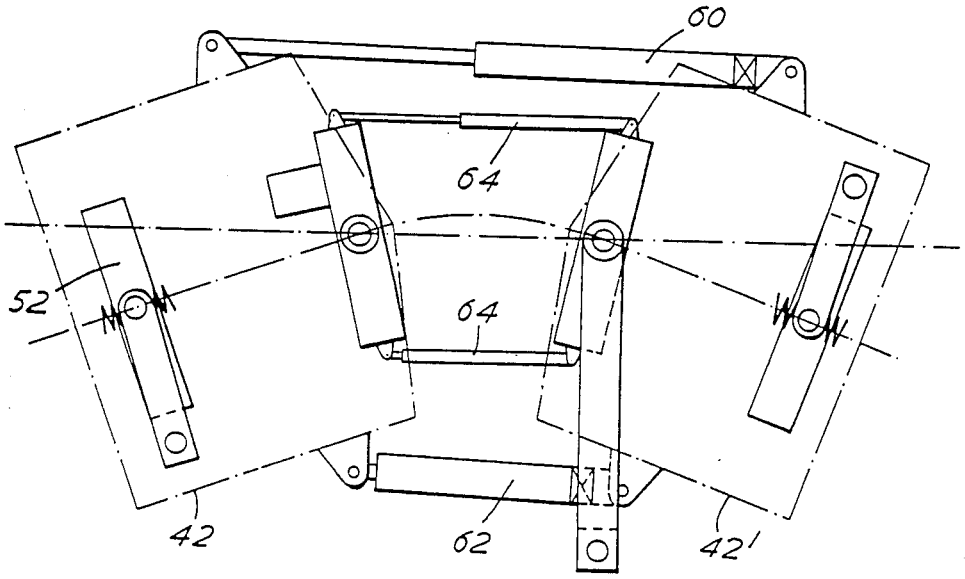

Referring now to FIG. 14, the manner in which the apparatus may be used to impart three-point and four-point bending will now be described. In order to apply four-point bending, the screwjacks 60 and 62 apply equal and opposite load and thus swing both of the swinging frames 42, 42' relative to the fixed base. In this mode, the two linear transducers 64 measure the change in radius as the workpiece is bent (FIG. 14*b*).

Three point bending is achieved by locking the swing frames 42' in the position shown in FIG. 14*a* by suitable means (not shown) and applying bending loads through the actuation of the swing frame 42 using the screwjacks 60 and 62. In this mode, the change in radius of the stringer as it is bent is by means of an encoder to indicate the change in angle of the swing frame.

Support System (FIGS. 15 to 17)

The support system is designed to support a workpiece during the forming process in a substantially unstressed condition. The support system comprises a series of support stands 130 and an end support stand 131 spaced alongside the rails of the manipulator (see FIG. 5). Each stand comprises a vertical main pillar 132 on which is mounted a cantilevered support arm 134 for vertical movement between a top position FIG. 14(*b*) and a run-over position FIG. 14(*c*).

In the run-over position, the support arm is located so that the manipulator can move over and past the support arm as the manipulator moves from one position to the next.

The support arm includes a lateral traverse carriage 136 which supports a workpiece location device 138. This device may simply be in the form of a V-shaped stirrup in which the workpiece rests. Each lateral carriage 136 is connected by belt drive to a lateral damper 140. In the vertical sense, vertical damping is also provided, and a disc brake 142 is operable to lock the support arm in a required position. A counterbalance system comprises a fixed counterbalance weight 144 to react the support structure and a variable weight arrangement 146 capable of accommodating variations in workpiece weight. This latter arrangement may comprise a fluid reservoir to and form which fluid, e.g. water, may be supplied to vary the counterbalance weight.

Referring to FIGS. 16 and 17, the end support stand 131 is of similar construction as the support stands 130 except that it includes a secondary pillar 150 which supports the support arm 134 at its outer end, and the lateral carriage 136 incorporates a workpiece anchor 152 having a single pin attachment to the stringer end.

The anchor 152 is incorporated into a one-way valve air cylinder 154 and incorporates a universal joint and swivel joint 156 to accommodate flexural changes in the workpiece during manipulation. The purpose of the arrangement is to allow for an effective contraction of the workpiece as a result of manipulation whilst still supporting the workpiece end. The air cylinder is one-way to be free running during the workpiece forming mode so that no adverse bending moments will be induced in the workpiece. On completion of the forming cycle, with the workpiece unclamped within the manipulator, the air cylinder is actuated to draw the stringer end back to datum.

Positioning System

As referred to above, the manipulator is provided with tracks and a drive arrangement which allows it to run the length of the forming facility. The tracks include cut-outs adjacent each support stand 130 to allow the manipulator to move over the support arms during the forming process. Also, the turntable allows the manipulator to move about a vertical axis with respect to the tracks.

Control System

The control system stores data which, for an entire range of workpieces, defines mathematically the required contour of the workpiece at points spaced at, say ½" (12 mm) pitch along the length of the workpiece. As well as storing this data for selected points the system is capable of interpolating from the stored data to derive data for any point on the workpiece. The control system includes algorithms for calculating the contour or shape corrections to which the workpiece needs to be subjected. These forming algorithms use raw workpiece data together with shape data which are extracted from the various sensors associated with the overall facility. The control system controls the manipulator and the positioning system to incrementally apply bending and twist loads to cause the workpiece to have a required contour.

Operation of the System of FIGS. 5 to 15

The forming of a structural stringer using the above apparatus will now be described.

Because the stringer is of an unknown contour when first loaded into the facility, it must be measured by the manipulating control system (the machine will grip and measure what it is holding) so that the control system is able to calculate the contour or shape error to form the stringer from initial contour to required contour. As previously discussed the initial contour may be determined by a number of factors, not least of which will be the distortion factor arising from the machining operation and this may not be consistent over a product range of identical stringer forms. The sensors 64, 75 mounted on the inner clamp heads 44 and 56 measure the contour of the installed stringer between these heads. Thus, by clamping on the inner heads, the initial shape can be measured and fed into the control system.

By knowing the initial contour and required contour the control systems determines and applies increments in displacement to the stringer, measuring the resulting loads and achieving the required contour.

The load cell arrangements on the inner clamp heads measure the applied load (both bends and twist) to control forming.

Each clamp head, being capable of rotation by means of assembly 70 allows the stringer to be indexed through 9020 . Thus both lateral and vertical bending can be applied to the stringer by the manipulating system which can only deflect in the lateral plane. Furthermore twisting of the stringer section is achieved by locking brake clamp head 44 and rotating the torsion clamp head 56 by means of the torque motor 94 in driving engagement with the annular gear ring 68. The outer reaction heads 52 and 58 are free to rotate such that the applied torsion load to the stringer section is constrained to the length between the inner heads.

It should be noted that when a straight stringer is bent to a certain radius, the effective distance between the stringer ends decreases thus giving an apparent 'pull in' effect. Unless allowed for this can lead to high axial loads within the stringer. This is overcome by a degree of spring-loaded float.

A typical operating cycle is described below:

1. The next component is identified to control system by the operator entering part number via a keyboard on the operator's console;
2. The next component is placed on the support system, with the stringer base horizontal;
3. The stringer end anchored axially to prevent is being pulled along with the manipulating system when the manipulating system moves to the next position;
4. The manipulating system is positioned on the end of the stringer;
5. The stringer is gripped by the inner clamp heads 44, 56;
6. The sensors measure the initial lateral bend and axial twist;
7. The lateral bending loads are applied;
8. The twisting load is applied;
9. The outer heads are released;
10. The sensors check that the resulting lateral bend and axial twist are acceptable (if not, the process is repeated from 7).

Two alternative strategies are now possible to continue the forming operation:

Strategy 1 involves completing the vertical bending on the current section of stringer before moving to the next section. This involves the rotation of the stringer through 90° and movement of the support system to compensate.

Strategy 2 involves moving on to the next section of stringer to perform lateral bending and axial twisting and hence avoids rotation of the stringer and movement of the support system. The penalty, however, is that the stringer requires a second pass of the manipulating system to input the vertical bend component. The advantage is that cycle time is not affected by the 'settling' time required for the support system to compensate for movement of the stringer.

It will be appreciated that the process of forming comprises a combination of four basic steps, namely:

(1) Move from position on track to next.
(2) Twisting
(3) 4 point and/or three point operation.
(4) Form in any axis vertical or lateral or some intermediate axis on certain sections to avoid sideways distortion.

It will be noted that the described system forms a workpiece to a desired contour, without applying excessive strain and also without requiring details of the initial contour of the workpiece or it material and stiffness properties.

Referring now to the second embodiment of apparatus illustrated in FIGS. 18 to 30, the apparatus principally comprises a four-point bending manipulator 201 by which means controlled deflections are imparted to a stringer 202 via four clamping heads 203, 204, 205 and 206 which comprise the nub of the manipulating system. For reasons of clarity, the stringer is generally indicated as a respective centre line only, typical forms of stringer having been previously discussed.

The manipulator further includes a structural assembly 207 comprising a main frame portion 208 to which the clamping heads 203 and 204 are pivotally mounted and a swinging frame portion 209 to which the clamping heads 205 and 206 are pivotally mounted. The swinging frame position 209 pivotally locates on a vertical axis 210 to a support link assembly 211, itself pivotally located about a vertical axis 212 to the main frame portion 208. Pivotal attachment of the clamping heads 203 and 206 to their respective frame portions 208 and 209 is via intermediate support link elements 213 and more clearly illustrated with reference to FIG. 30. Each support link includes upper and lower pivotal attachments 214 to their respective frame portions, the upper and lower arms 215 extending inwardly to terminate in trunnion mounting attachments 216 for the respective clamping heads 203 and 206. Incorporated into the trunnion mounting attachment is a spring centering arrangement 217. Pivotal attachment of the clamping heads 204 and 205 is more clearly illustrated by reference to FIG. 29 which, although specifically shown with respect to the clamping head 204 has similarity in the means of pivotal attachment whereby upper and lower attachment brackets 218 include pivotal attachments 219 for trunnion bearings 220 extending from the clamping head casing. Mounting brackets 221 and 222 on the respective frame positions 208 and 208 provide pivotal attachments for a pair of linear actuators 223. The inner clamping heads 204 and 205 are interconnected by a pair of linear displacement transducers whose function will be later defined.

Each of the clamping heads comprises an annular clamp head outer casing 224 having an inner ring bearing surface 225 co-operating with an inner clamp head portion 226 which is capable of rotational displacement of 200°. Disc brake locking means, not shown, enables each clamp head to be locked against rotation in any angular position. Powered rotation is applied in the case of clamping head 204 by means of annular gear ring 227 located to the inner clamp head portion, engaging a torsion gear box 228 and driven by a torsion motor 229. This is illustrated in FIG. 29 which also shows a typical arrangement of stringer clamping applicable at each clamping head and comprising clamp blocks 230 and 231 respectively engaging clamp wedges 232 and 233 each respectively powered by clamp jacks 234 and 235. In this FIG. alternative stringer cross sections, a J-section 36 and 37 are shown merely to indicate the location which they would take relative to the clamps. FIG. 25 shows typical dispositions of clamping blocks relative to a J-section stringer prior to the clamping operation.

The manipulating system will only form a small length of stringer at a time. Hence to form the entire length of a stringer which may be in excess of 50 feet long (15.25 meters), the manipulating system must be capable of movement relative to the stringer so that the final stringer configuration is achieved as a series of progressions. A typical stringer manipulating facility will now be described with reference to FIGS. 22 and 23 in which the fourpoint manipulator 201 is mounted upon a powered turntable 239 incorporated in a base member 240 engaging floor mounted tracks 241 which include traversing racks. Thus the manipulator is moved relative to the installed stringer 202 as illustrated in FIG. 23 in two positions of traverse by way of example. Because the manipulator grips a small portion of stringer, typically 50 inches (12.7 cm), a stringer support system is required comprising a number of spaced apart support stands 242. A typical stand is illustrated in FIG. 26 comprising a vertical pillar 243 and cantilevered support arm 244, including as indicated in FIGS. 27 and 28 a convex surface 245 incorporating an oppositely disposed arrangement of roller conveyors 246 to allow for lateral stringer movement with minimum friction. To compensate for movement of the stringer as it is being manipulated, the arm will be required to rise and fall, operated by actuating means 247 lying adjacent the vertical pillar 243. Furthermore, the arm includes hinges 248 enabling the support stands to be hinged to one side during traverse of the manipulator. Finally, an anchorage arm 249 (FIGS. 22 and 23) is provided configured to provide an axial location to the end of the stringer being manipulated to prevent longitudinal displacement when the manipulator is in traverse mode. This arm is hinged and foldable to accommodate changes in stringer position arising from manipulation. The method of manipulating the stringer to achieve the desired form will now be described in detail.

Control of the facility is by means of a computer whose prime task is control of the manipulating system. The computer will have access to a data file which will contain stringer contour data describing the required shape of the full range of stringers.

Because the stringer is of an unknown contour when first loaded into the facility, it must be measured so that the control system is able to calculate forming displacements to form the stringer from initial contour to required contour. As previously discussed the initial contour may be determined by a number of factors, not least of which will be the distortion factor arising from the machining operation and this may be consistent over a product range of identical stringer forms. To deal with this, sensors are mounted on the inner clamping heads 204 and 205 to measure the contour of the installed stringer between these heads. Thus, by clamping on the inner heads, the initial shape can be measured and fed into the control system.

By knowing the initial contour and required contour the control systems determines the contour error and applies bending or twisting loads to the stringer to achieve this required contour.

Further sensors are mounted on each of the four clamp heads to measure applied load (both bend and twist) to control forming.

The control system also controls the support system and the positioning system.

Forming of stringers is carried out by applying controlled deflections to the stringer via the four clamping heads 203, 204, 205 and 206. Four point bending is achieved by powering the two linear actuators 223 causing one pair of heads 205 and 206 to deflect laterally with respect to the other pair 203 and 204. Whilst four point bending represents the ideal arrangement, three point bending can be achieved for use at stringer ends only by unclamping one of the outer heads 203 or 206 thus applying bending loads through three clamp heads only. The two displacement transducers 238 measure the change in radius of the stringer as it is bent.

Each clamp head, being capable of rotation on its ring bearing 225 allows the stringer to be indexed through 90°. Thus both lateral and vertical bending can be applied to the stringer by the manipulating system which can only deflect in the lateral plane. Furthermore twisting of the stringer section is achieved by locking inner clamp head 205 and rotating the other inner head 204 by means of the torque motor in driving engagement with the annular gear ring 227. The outer heads 203 and 205 are free to rotate such that the applied torsion load to the stringer section is constrained to the length between the inner heads.

It should be noted that when a straight stringer is bent to a certain radius, the effective distance between the stringer ends decreases thus giving an apparent 'pull in' effect. Unless allowed for this can lead to high axial loads within the stringer. This is overcome by a degree of float in the respective trunnion mountings 216 on the outer heads 203 and 206, this movement being spring loaded by means of the spring centering arrangement 217.

The operation of the second embodiment of stringer forming facility is similar in principle to that of the first described embodiment and will not be described again.

What is claimed is:

1. A method of forming an elongate structural component, such as a stringer, to have a predetermined contour, which comprises the steps of:

clamping a portion of the said component between longitudinally spaced manipulator means;

manipulating said portion, whilst substantially stationary relative to said manipulator means, to apply permanent set deflections in a twisting sense and in at least one bending sense to at least a part of said portion, said step of manipulating including loading said portion, monitoring the applied load and resultant deflection during said loading, deducing the plastic deformation component of the resultant deflection, and applying sufficient loading to provide a plastic deformation which substantially matches the corresponding deflection of said predetermined contour;

thereafter unclamping said portion of said component and advancing one of said component and manipulator means relative to the other of said manipulator means and component, and repeating said clamping, manipulating, unclamping and advancing steps on at least one further portion of said component until said component has said predetermined contour.

2. A method according to claim 1, wherein said step of manipulating includes determining the contour of at least part of said engaged portion before applying the permanent set deflections.

3. A method according to claim 1, wherein said step of manipulating comprises separately applying permanent set deflections in each of a twisting sense and two bending senses.

4. A method according to claim 3, wherein said manipulator means is operable to apply bending deflections in a single sense and said step of manipulating includes rotating said component relative to said manipulator means between successive bending deflections to allow bending deflections to be applied to said component in two angularly displaced senses.

5. A method according to claim 4, wherein said angularly displaced senses are the vertical and lateral bend senses.

6. A method of forming an elongate structural component, such as a stringer, to have a predetermined contour, which comprises the steps of:

clamping a portion of the said component between longitudinally spaced manipulator means;

manipulating said portion, whilst substantially stationary relative to said manipulator means, to apply permanent set deflections in a twisting sense and in at least one bending sense to at least a part of said portion, said step of manipulating including loading said portion, monitoring the applied load and resultant deflection during said loading, deducing the plastic deformation component of the resultant deflection, and applying sufficient loading to provide a plastic deformation which substantially matches the corresponding deflection of said predetermined contour;

unclamping said portion of said component and thereafter advancing one of said component and manipulator means relative to the other of said manipulator means and component, and repeating said clamping, manipulating, unclamping and advancing steps on at least one further portion of said component until said component has said predetermined contour, wherein said manipulator means is selectively operable to effect three of four point bending.

7. A method of forming an elongate structural component, such as a stringer, to have a predetermined contour, which comprises the steps of:

clamping a portion of the said component between longitudinally spaced manipulator means;

manipulating said portion, whilst substantially stationary relative to said manipulator means, to apply permanent set deflections in a twisting sense and in at least one bending sense to at least a part of said portion, said step of manipulating including loading said portion, monitoring the applied load and resultant deflection during said loading, deducing the plastic deformation component of the resultant deflection, and applying sufficient loading to provide a plastic deformation which substantially matches the corresponding deflection of said predetermined contour;

unclamping said portion of said component and thereafter advancing one of said component and manipulator means relative to the other of said manipulator means and component, and repeating said clamping, manipulating, unclamping and advancing steps on at least one further portion of said component until said component has said predetermined contour, wherein one end of said elongate structural component is anchored to an anchorage means, there being support means spaced longitudinally of the component to support said component but allow movement thereof due to said manipulation, and said manipulator means moves longitudinally with respect to said anchorage means to advance relative thereto.

8. A method of forming an elongate structural component to have a predetermined contour comprises applying a manipulator means to engage a selected relatively stationary increment of the length of said component, measuring the initial contour of said component, comparing the measured contour with the desired contour, loading said increment to deflect a portion of said component, monitoring the load applied and the resultant deflection to deduce the plastic deformation component of said resultant deflection, applying to the increment sufficient bending moment and torsion to apply a plastic deformation in accordance with the desired contour, thereafter disengaging said manipulator means and advancing one of the component and manipulator means relative to the other of the manipulator means and component, and repeating said measuring, comparison, applying, disengaging and advancing until the component has the required contour.

* * * * *